US007909138B2

(12) United States Patent
Svehlek

(10) Patent No.: US 7,909,138 B2
(45) Date of Patent: Mar. 22, 2011

(54) LADDER SECURITY BRACKET AND SAFETY SYSTEM

(75) Inventor: John R. Svehlek, New Berlin, WI (US)

(73) Assignee: John R. Svehlek, New Berlin, WI (US)

( * ) Notice: Subject to any disclaimer, the term of this patent is extended or adjusted under 35 U.S.C. 154(b) by 0 days.

(21) Appl. No.: 12/020,745

(22) Filed: Jan. 28, 2008

(65) Prior Publication Data

US 2008/0230315 A1 Sep. 25, 2008

Related U.S. Application Data

(63) Continuation of application No. 11/962,280, filed on Dec. 21, 2007.

(60) Provisional application No. 60/896,009, filed on Mar. 21, 2007.

(51) Int. Cl.
*E04G 5/14* (2006.01)

(52) U.S. Cl. ..... 182/112; 182/107; 182/113; 182/117; 256/DIG. 6

(58) Field of Classification Search ..... 182/107, 182/117, 112, 113, 118, 119, 123; 256/DIG. 6
See application file for complete search history.

(56) References Cited

U.S. PATENT DOCUMENTS 567,755 A * 9/1896 Stillman ..... 248/238
623,269 A * 4/1899 Wilber ..... 182/103
1,143,678 A * 6/1915 Winans ..... 248/238
1,474,289 A * 11/1923 Reimann ..... 248/238
2,245,223 A * 6/1941 O'Meara ..... 182/14
2,308,832 A * 1/1943 Roney et al. ..... 182/117
2,426,825 A * 9/1947 Geary ..... 248/237
2,910,135 A * 10/1959 Moore ..... 182/113
3,026,963 A * 3/1962 Wilkie ..... 182/93
3,480,257 A * 11/1969 Bourn ..... 256/59
3,853,203 A * 12/1974 Werner et al. ..... 182/113
3,854,550 A * 12/1974 Shingler ..... 182/36
3,867,997 A * 2/1975 Hyslop, Jr. ..... 182/113
4,236,698 A * 12/1980 Compte ..... 256/23
4,253,548 A * 3/1981 Beeche ..... 182/142
4,303,145 A * 12/1981 Vazquez ..... 182/122
4,542,874 A * 9/1985 Ronning ..... 248/238
4,666,131 A * 5/1987 Kettelkamp et al. ..... 256/59
4,901,818 A * 2/1990 Schmitt ..... 182/117
4,909,351 A * 3/1990 Johnson et al. ..... 182/121
4,941,547 A * 7/1990 Livick ..... 182/107
4,991,808 A * 2/1991 LaChance ..... 248/211
5,020,757 A * 6/1991 Sulecki et al. ..... 248/238
5,769,181 A * 6/1998 Gussow et al. ..... 182/118
5,855,252 A * 1/1999 Vrolyks ..... 182/214
5,862,881 A * 1/1999 O'Brien ..... 182/117
6,015,028 A * 1/2000 Smith ..... 182/136
6,039,150 A * 3/2000 Palmer ..... 182/113
6,045,102 A * 4/2000 Terenzoni ..... 248/238
6,109,391 A * 8/2000 Tyson ..... 182/117

(Continued)

*Primary Examiner* — Katherine Mitchell
*Assistant Examiner* — Colleen M Quinn
(74) *Attorney, Agent, or Firm* — Kirk Ekena

(57) ABSTRACT

A system of increased safety when performing work using a ladder is described. The system includes a ladder bracket for temporarily attachment of a ladder to a structure to stabilize or secure the ladder. The bracket is easy to install and acts to limit or prevent slippage of the ladder laterally or away from the structure and generally promotes a greater margin of safety. In addition, the system includes a bracket for temporarily, yet securely, attaching a safety railing to a ladder.

17 Claims, 23 Drawing Sheets

U.S. PATENT DOCUMENTS 6,557,667 B1 * 5/2003 Ward ..... 182/129
6,575,268 B2 * 6/2003 Carder et al. ..... 182/118
6,662,902 B1 * 12/2003 McGuire ..... 182/117
6,782,972 B1 * 8/2004 Hatch et al. ..... 182/102
6,883,642 B2 * 4/2005 Matty ..... 182/117
2006/0196724 A1 * 9/2006 Suterski ..... 182/117

* cited by examiner

FIG. 1A. ISOMETRIC
NOT TO SCALE

FIG. 1B. FRONT

FIG. 1C. SIDE

WORK SAFE
SINGLE FULL WRAP
LADDER BRACKET

WORK SAFE
SINGLE ONE SIDE
ANGLED LADDER BRACKET

FIG. 2A. ISOMETRIC
NOT TO SCALE

FIG. 2B. FRONT

FIG. 2C. SIDE

FIG. 3A. ISOMETRIC
NOT TO SCALE

FIG. 3C. SIDE

FIG. 3B. FRONT

WORK SAFE
DOUBLE FULL WRAP
LADDER BRACKET
WITH GUTTER

FIG. 4A. ISOMETRIC
NOT TO SCALE

FIG. 4C. SIDE

NOTE: ALL INNER RADII
SHALL BE 0.50"

FIG. 4B. FRONT

WORK SAFE
SINGLE ONE SIDE
LADDER BRACKET

FIG. 5A. ISOMETRIC
NOT TO SCALE

FIG. 5C. SIDE

NOTE: ALL INNER RADII
SHALL BE 0.50"

FIG. 5B. FRONT

WORK SAFE
DOUBLE ONE SIDE
LADDER BRACKET

FIG. 6A. ISOMETRIC
NOT TO SCALE

FIG. 6B. FRONT

FIG. 6C. SIDE

WORK SAFE
ONE SIDE
LADDER BRACKET
WITH GUTTER

WORK SAFE
SINGLE ONE SIDE
HALF LADDER BRACKET

FIG. 7A. ISOMETRIC
NOT TO SCALE

FIG. 7C. SIDE

NOTE: ALL INNER RADII
SHALL BE 0.50"

FIG. 7B. FRONT

FIG. 8A ISOMETRIC
NOT TO SCALE

FIG. 8C. SIDE

FIG. 8B. FRONT

WORK SAFE
FULL WRAP
ADJUSTABLE
LADDER BRACKET

FIG. 9A. ISOMETRIC
NOT TO SCALE

FIG. 9B. FRONT

FIG. 9C. SIDE

WORK SAFE
ONE SIDE
ADJUSTABLE
LADDER BRACKET

FIG. 10C. SIDE

FIG. 10B. FRONT

FIG. 10A. ISOMETRIC
NOT TO SCALE

WORK SAFE
RAILING SUPPORT
LADDER BRACKET

FIG. 11A. ISOMETRIC
NOT TO SCALE

WORK SAFE
RAIL

FIG. 12A. ISOMETRIC
NOT TO SCALE

FIG. 12B. FRONT

FIG. 12C. SIDE

WORK SAFE
RAILING SYSTEM
END STOP
LEFT SIDE

FIG. 13A. ISOMETRIC
NOT TO SCALE

FIG. 13B. FRONT

FIG. 13C. SIDE

WORK SAFE
RAILING SYSTEM
END STOP
RIGHT SIDE

WORK SAFE
SYSTEM COMPONENTS

FIG. 15A. ISOMETRIC
NOT TO SCALE

FIG. 15C. SIDE

NOTE: ALL INNER RADII
SHALL BE 0.50"
UNLESS OTHERWISE NOTED

FIG. 15B. FRONT

WORK SAFE
LADDER RUNG
TOOL HOOK

WORK SAFE
DOUBLE FULL WRAP
ANGLED LADDER BRACKET
WITH GUTTER

FIG. 17A. ISOMETRIC
NOT TO SCALE

FIG. 17C. SIDE

NOTE: ALL INNER RADII
SHALL BE 0.50"

FIG. 17B. FRONT

WORK SAFE
DOUBLE ONE SIDE
ANGLED LADDER BRACKET

WORK SAFE
ONE SIDE ANGLED
LADDER BRACKET
WITH GUTTER

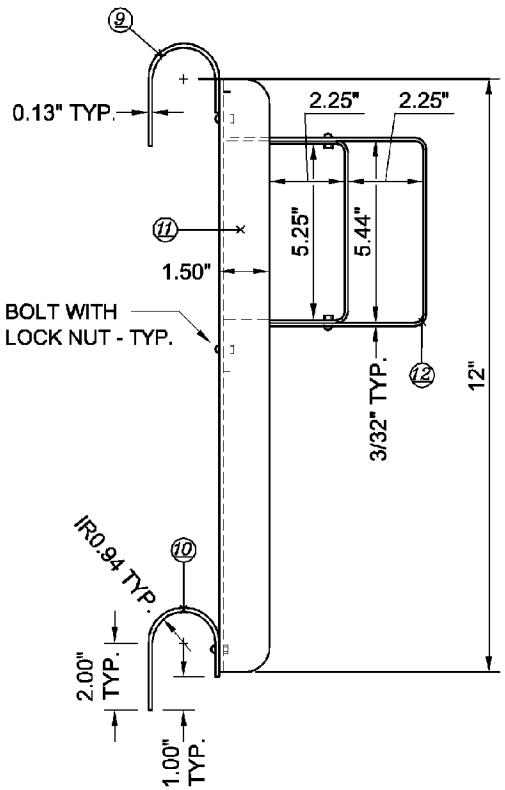
FIG. 19C. SIDE
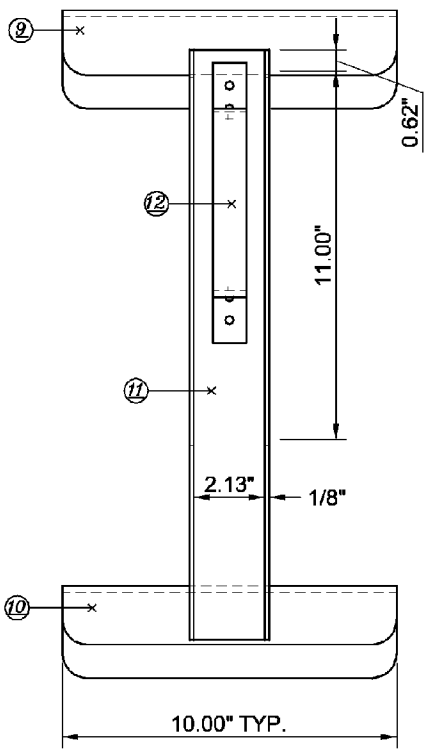
FIG. 19B. FRONT
FIG. 19
WORK SAFE RAILING SUPPORT
LADDER BRACKET
SINGLE RAIL
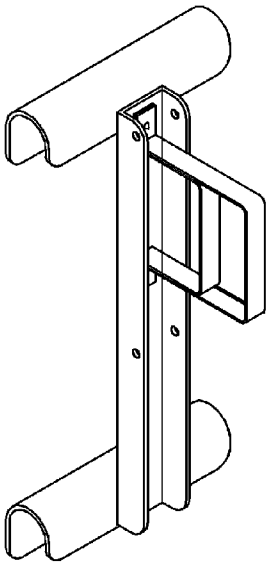
FIG. 19A. ISOMETRIC
NOT TO SCALE

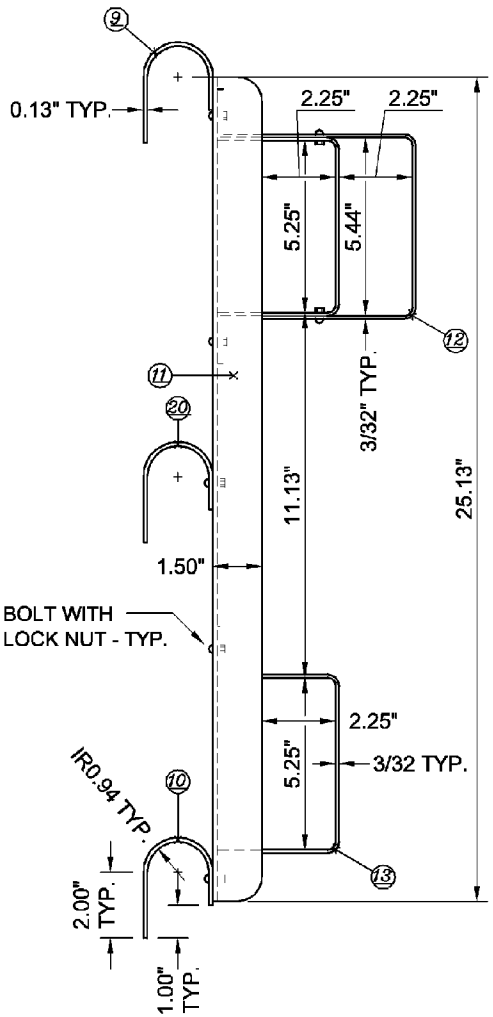
FIG. 20C. SIDE
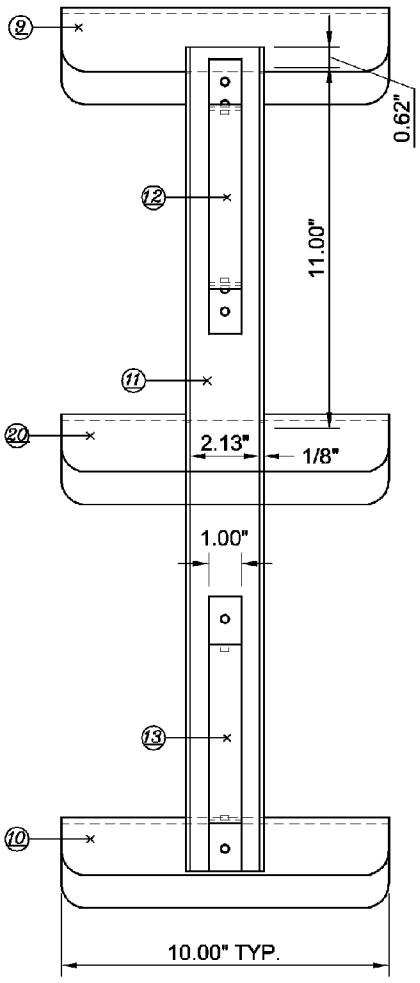
FIG. 20B. FRONT
FIG. 20
WORK SAFE RAILING SUPPORT
LADDER BRACKET
THREE RUNG
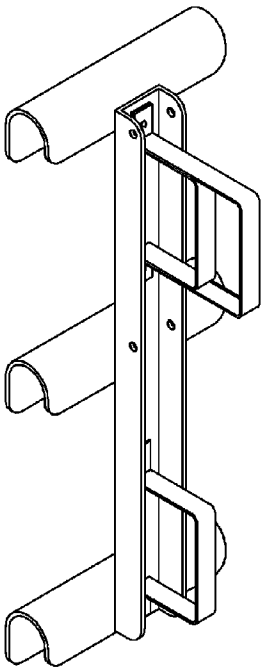
FIG. 20A. ISOMETRIC
NOT TO SCALE

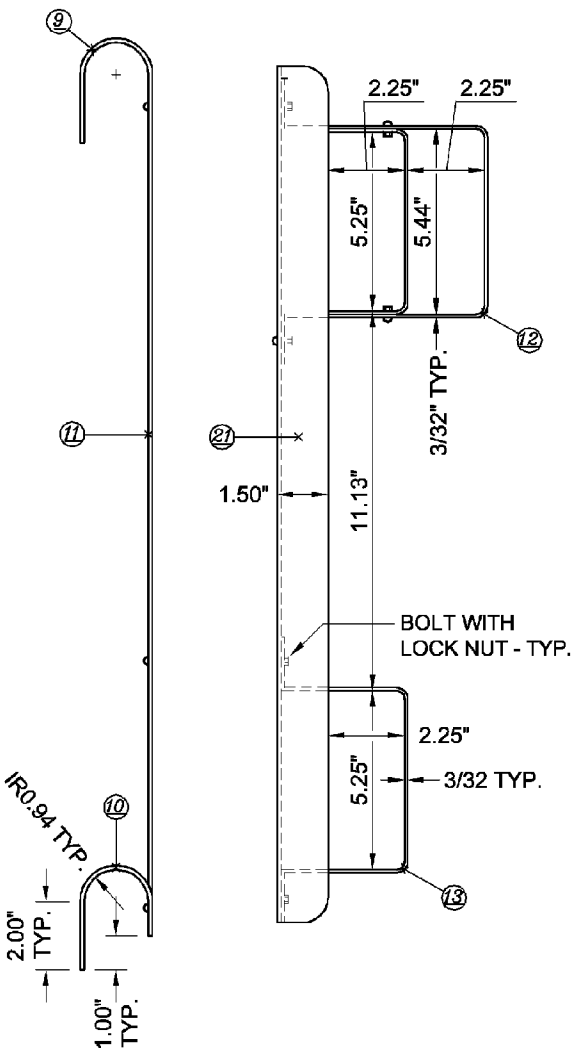
FIG. 21C. SIDE
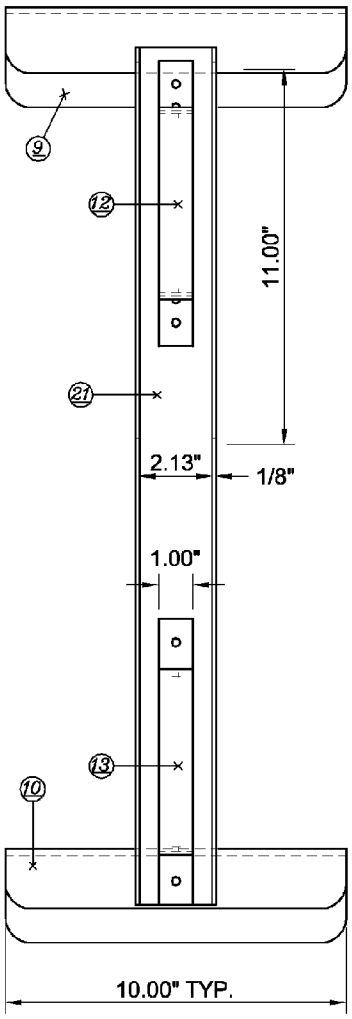
FIG. 21B. FRONT
FIG. 21
WORK SAFE RAILING SUPPORT
LADDER BRACKET
TWO PART
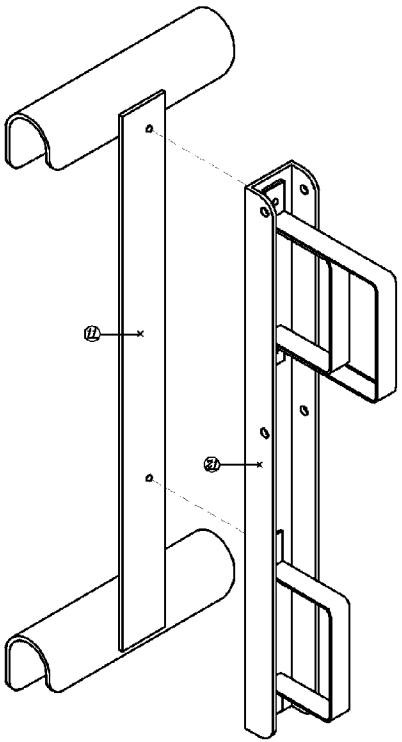
FIG. 21A. ISOMETRIC
NOT TO SCALE

FIG. 22A. SQUARE

FIG. 22B. ROUND

FIG. 22C. OVAL

FIG. 22D. POLYGONAL
OCTAGON
HEXAGON

WORK
SAFE
RAILING
SUPPORT
LADDER
BRACKET
ALTERNATE
SHAPES

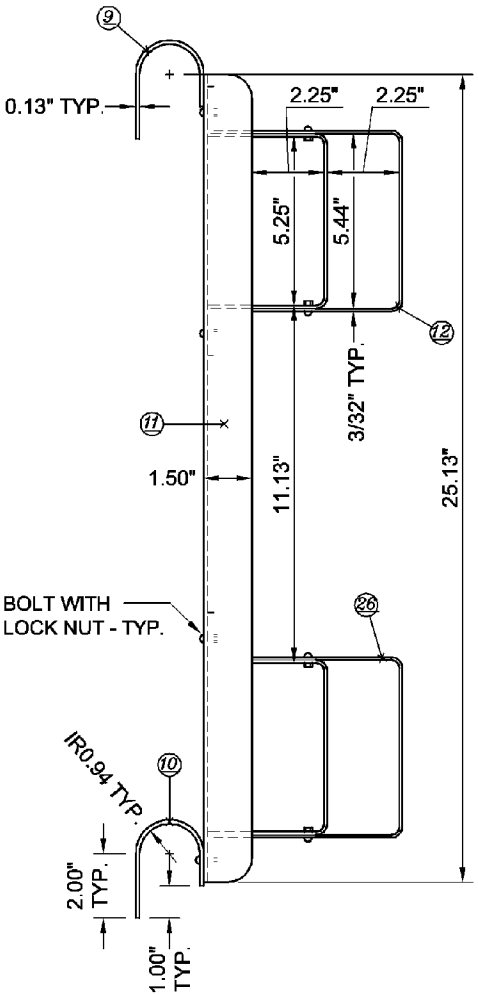
FIG. 23C. SIDE
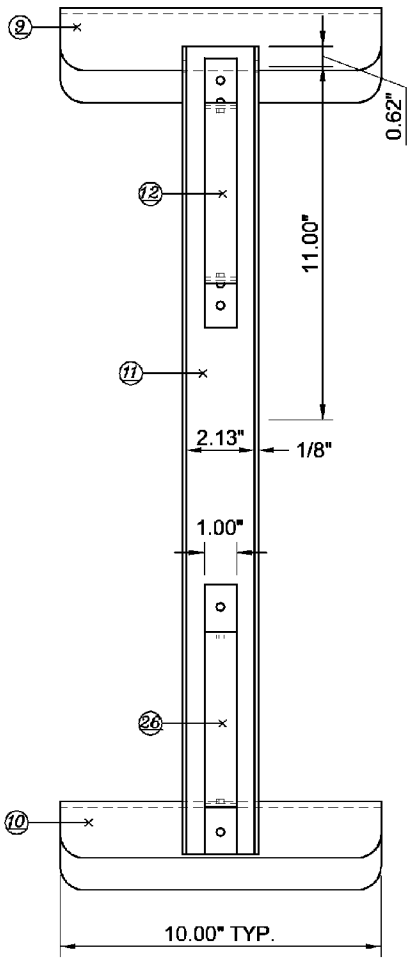
FIG. 23B. FRONT
FIG. 23
WORK SAFE RAILING SUPPORT
LADDER BRACKET
TWO RAILS
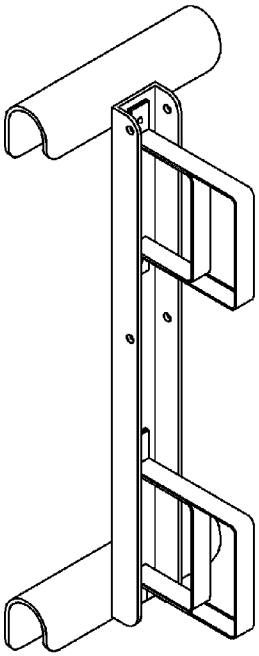
FIG. 23A. ISOMETRIC
NOT TO SCALE

LADDER SECURITY BRACKET AND SAFETY SYSTEM

CROSS-REFERENCE TO RELATED APPLICATIONS

This application is a continuation of application Ser. No. 11/962,280 filed Dec. 21, 2007, which claims the benefit of U.S. Provisional Application No. 60/896,009 filed Mar. 21, 2007. Application Ser. No. 11/962,280 is incorporated herein by reference.

BACKGROUND OF THE INVENTION

Ladders are ubiquitous tools used in a wide variety of industrial and domestic environments. Ladders are important tools, for example, in the construction trades. One type of ladder does not stand alone but must be leaned against a wall or other structure in order to support a user. Ladders of this type include extension ladders. Alternately, some step ladders may be used in a stand alone mode, or may be folded and leaned against a wall during use.

To perform work on upper out-of-reach surfaces of structures, such as a roof, it is typical to position a ladder against or near the structure to gain access to work surfaces. Roofs of residential homes and other buildings are often inaccessible by stepladders or other means, requiring a ladder, such as an extension ladder, to be leaned against the side of the structure for a degree of support that allows the user to climb the ladder and gain access to upper portions of the structure.

Ladders that are leaned against a structure tend to shift from side to side (translate laterally). The ladder may translate laterally to such an extent that it falls to one side or the other or causes a person standing on the ladder to fall or work in an unsafe position. The base of the ladder may also slide away from the structure, ladder slippage, causing the ladder to fall. In some instances, such as when the base of the ladder is positioned too close to the structure and the ladder is in a too upright vertical position, a force may push the ladder away from the structure or a person or object on the ladder causes the center of gravity to pull the ladder away from the structure. When this occurs, the upper end of the ladder may move away from the structure, causing the ladder to fall away from the structure.

Of necessity, ladders are used on a variety of surfaces and in many instances the ground or surface on which they are used is uneven, sloped, stepped or in some way soft or unstable. Such conditions make the ladder prone to movement when a person stands on any of the higher rungs of the ladder, especially if the ground is soft or otherwise less stable than expected. In any event, even when used on stable level ground there is still an inherent risk of unwanted ladder movement, especially when used over longer reaches.

A simple, easy to use ladder security device is needed that can be firmly secured to a variety of structures and prevent excessive lateral motion of the ladder, ladder slippage, or ladder movement away from the structure. Such a device would significantly improve ladder safety. An ideal ladder stabilizer would not require attachment to the ladder side rails or rungs. Such a ladder stabilizer would be simple to install, without cumbersome moving parts. It should also be easy to manufacture, and relatively inexpensive.

A variety of attachments have been made to work with ladders. On of the more common attachments in the construction industry is the ladder jack and plank. When two ladder jacks are placed on two ladders placed some distance apart, and a plank (e.g., stretch plank or walk plank) is placed on the jacks, an elevated working surface on which a person can stand, similar to a scaffold, is created. This elevated platform would benefit from the addition of a safety railing system.

SUMMARY OF THE INVENTION

In a preferred embodiment, a system is described for improving safety when working on or with one or more ladders or ladder platform systems. The system comprises a bracket for securing the ladder, a bracket for holding a railing system, a rail end stop, and a ladder rung tool hook. The ladder security system is useful during any project requiring the use of a ladder, especially during exterior work during new construction or remodeling, such as new home construction or home remodeling.

In a preferred embodiment, the present invention relates to a ladder securing bracket (work safe ladder bracket) for temporary attachment to a structure, such as a building, residential home, or the like, for stabilizing or securing the upper end portion of a ladder. The device is easy to install and acts to limit or prevent slippage of the ladder laterally or vertically, thus promoting a greater margin of safety.

In another preferred embodiment, a ladder railing bracket is described. The ladder railing bracket provides a means to incorporate a safety railing when used in conjunction with scaffolding or platforms that are commonly used with ladders. The railing system is complemented by railing system end stops to more fully enclose the work area.

In another preferred embodiment, a tool hook is described. The tool hook fits through the rung of a ladder and holds a tool or other item to the side of the ladder. By holding the tool to the side of the ladder, a person is not required to work or climb around the item, thereby increasing safety when working on the ladder.

BRIEF DESCRIPTION OF THE DRAWINGS

FIG. 19. Illustration of several views of one embodiment, with exemplary dimensions, of a two rung ladder railing bracket comprising upper rung engagement member 9, lower rung engagement member 10, vertical post 11, and a double rail bracket 12. A) Perspective (isometric) view. B) Front view. C) Side view.

FIG. 20. Illustration of several views of one embodiment, with exemplary dimensions, of a three rung ladder railing bracket comprising upper rung engagement member 9, lower rung engagement member 10, middle rung bracket 20, vertical post 11, double upper rail bracket 12 and lower single rail bracket 13. A) Perspective (isometric) view. B) Front view. C) Side view.

FIG. 21. Illustration of several views of one embodiment, with exemplary dimensions, of a three rung ladder railing bracket comprising upper rung engagement member 9, lower rung engagement member 10, vertical post 11, rail post 21, double upper rail bracket 12 and lower single rail bracket 13. A) Perspective (isometric) view. B) Front view. C) Side view.

FIG. 23. Illustration of several views of one embodiment, with exemplary dimensions, of a three rung ladder railing bracket comprising upper rung engagement member 9, lower rung engagement member 10, vertical post 11, double upper rail bracket 12 and lower double lower rail bracket 26. A) Perspective (isometric) view. B) Front view. C) Side view.

DETAILED DESCRIPTION OF THE INVENTION

Figure 1:
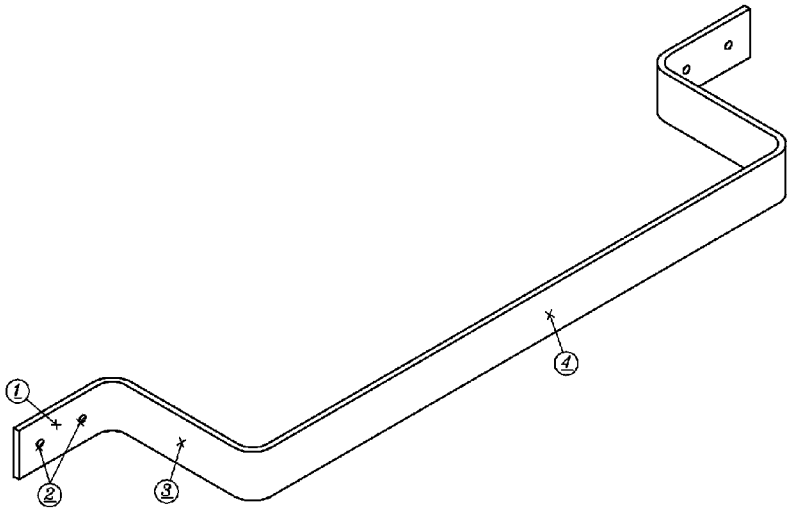
FIG. 1. Illustration of several views of one embodiment, with exemplary dimensions, of a single full wrap ladder bracket comprising: attachment members 1 with holes, 2, through which nails a screws can be inserted, lateral stop members 3, and transverse member 4. A) Perspective (isometric) view. B) Front view. C) Side view.
Figure 1:
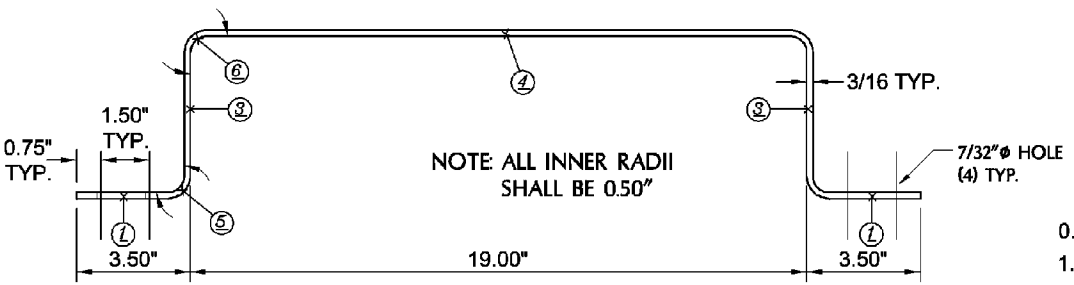
Figure 1:
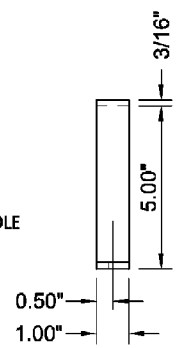
Figure 2:
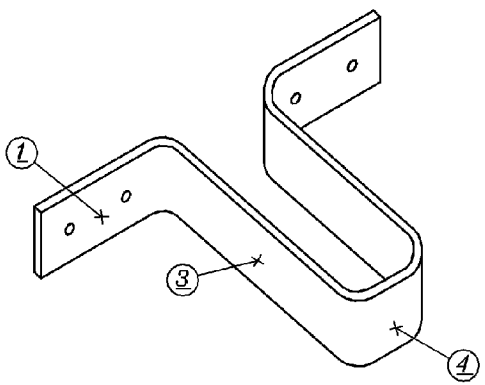
FIG. 2. Illustration of several views of one embodiment, with exemplary dimensions, of a ladder bracket. A) Perspective (isometric) view. B) Front view. C) Side view of a bracket with an angle lateral stop member. An angled lateral stop member may be useful in combination with angled fascia boards.
Figure 2:
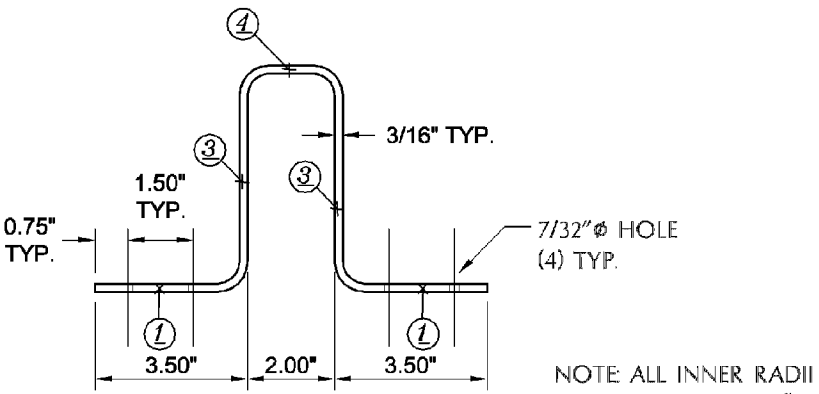
Figure 2:
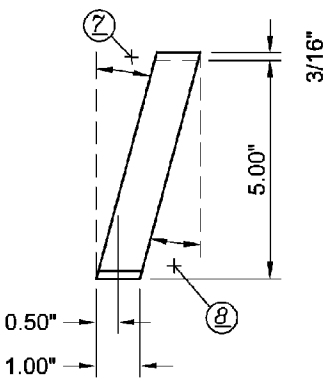

Described herein is a security system to improve safety when working with ladders. A first component of the security system comprises a ladder security bracket. The ladder security bracket limits lateral translation and slippage of a ladder. The ladder security bracket further limits movement of the top of a ladder outward away from a structure against which it is leaning. A second component of the security system comprises a railing bracket. The railing bracket mounts onto one or more rungs of a ladder and provides a means to install a safety railing between two laterally spaced ladders. The safety railing is particularly useful when working from a platform that is also mounted between the two ladders. A third component of the security system comprises railing end stops. The railing end stop provides a bar which extends perpendicularly from the rail used with the railing bracket. The railing end stop more fully encloses the elevated work platform. A fourth component of the security system comprises a ladder rung tool hook. The ladder rung tool hook mounts through the hollow rung of a ladder and provides a hook at the side of the ladder for hanging a tool or other item from the ladder.

A ladder can be described as a plurality of rungs extending between a pair of elongated rails. A single ladder is defined herein as a ladder or segment thereof in which there is a single pair of side rails between which are the rungs. A double ladder is defined herein as a ladder or segment thereof containing two single ladders. The term extension ladder is a well-known type of ladder in the art. An extension ladder contains two single ladders that are moveably connected to each other to provide a ladder of varying height. A ladder security bracket as described herein may be sized to fit a single ladder segment of an extension ladder or it may be sized to fit a double ladder segment of an extension ladder.

The present devices are usable on substantially all ladders manufactured. It is also to be appreciated that the present devices are so structured that no apertures, slots or modifications are formed in the ladder rails or rungs in incorporating the devices on the ladder. Therefore the ladder strength as designed and built by the manufacturer is not altered.

Security Bracket

Several embodiments of sadder security brackets are illustrated in FIG. 1-9. The ladder security bracket comprises: a mounting member or attachment means 1, a lateral stop 3 and a transverse member 4. The mounting member 1 contains a surface that is placed against a structure, such as the eave of a house, and provides a means by which to secure attachment of the ladder security bracket to the structure. The mounting member is typically a relatively planar bar-like or sheet-like portion, about 2 inches to about 6 inches in length, such as a nailing blade, which may be secured by suitable means such as screws or nails and the like to the structure. For attachment using screws or nails, the mounting member can have one, two, three, or more holes 2 through which a nail or screw can be driven, thus securing the ladder security bracket to the structure. The invention is not intended to be limited to the use of a nail or a screw inserted through a hole in the mounting member. A wide variety of means are known in the art by which the bracket can be temporarily or reversibly attached to the structure. For instance, in some embodiments, it may be possible to use clamps to secure the bracket to the structure. In one embodiment, the mounting member comprises a relatively flat section with one or more holes through which a nail or screw can be inserted to nail or screw the bracket to the structure. In another embodiment, a screw is used to attach the bracket to the structure and the screw is attached to the bracket. The screw can be attached to the bracket by any means typically used in the art. For example, a screw can be linked to the bracket by a cord or cable. Attachment of a screw or other device to the mounting members ensures that it is available to the installer.

Figure 3:
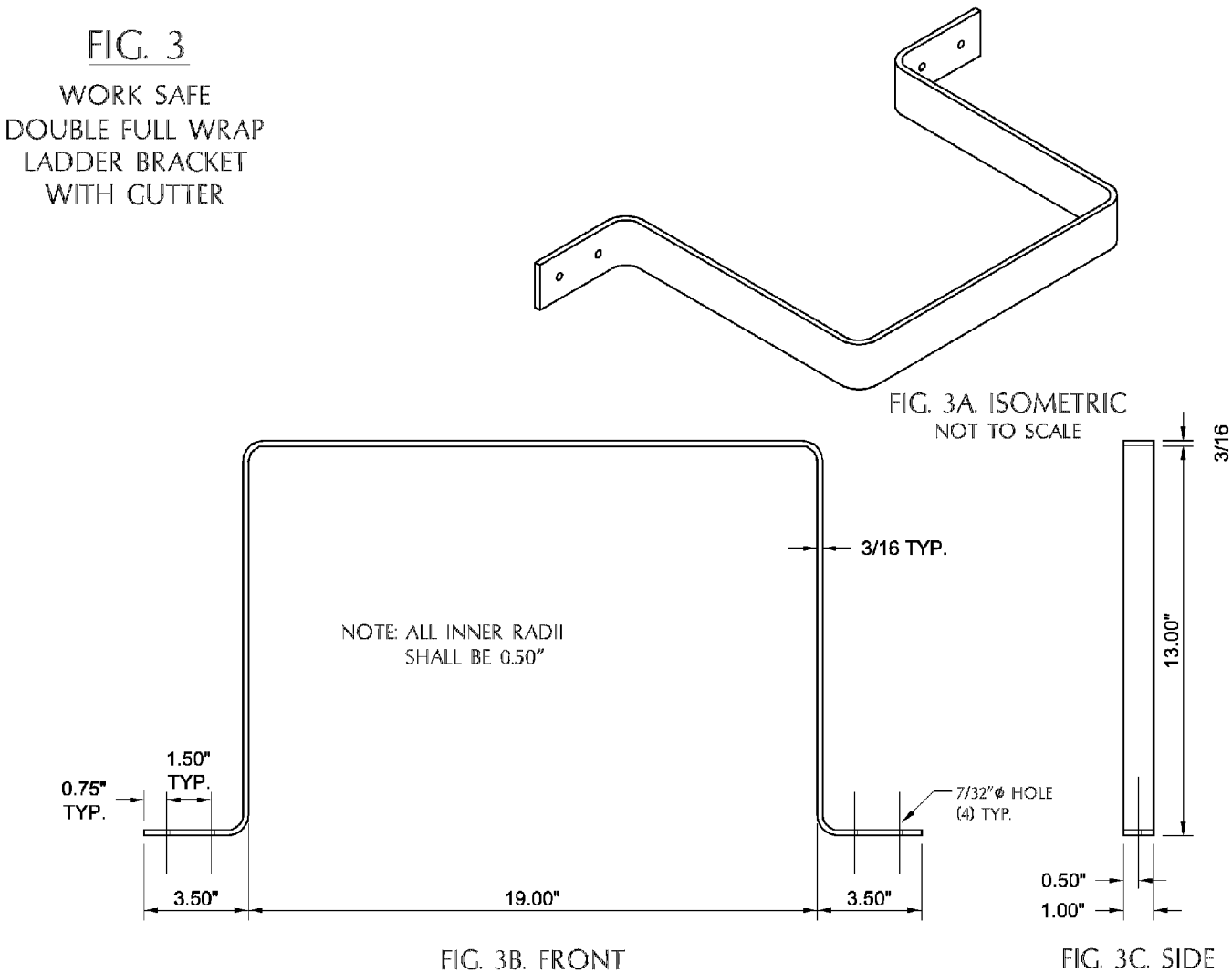
FIG. 3. Illustration of several views of one embodiment, with exemplary dimensions, of a double plus gutter full wrap ladder bracket. The lateral stop members are of sufficient length to allow the bracket to be attached to the structure and installed over a double rail ladder or section of ladder that is positioned against a gutter. A) Perspective (isometric) view. B) Front view. C) Side view.
Figure 4:
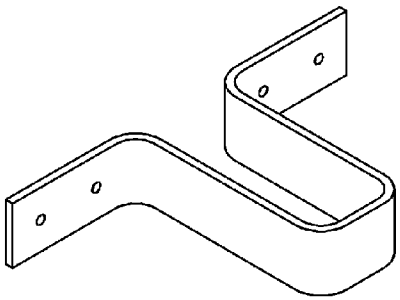
FIG. 4. Illustration of several views of one embodiment, with exemplary dimensions, of a single one side ladder bracket. A) Perspective (isometric) view. B) Front view. C) Side view.
Figure 4:
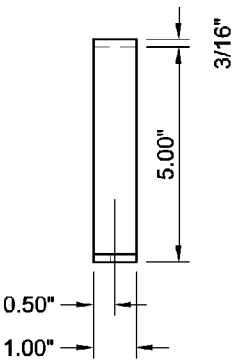
Figure 4:
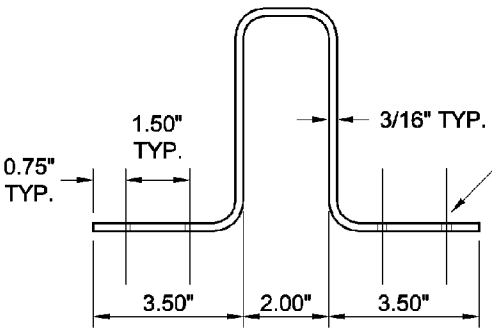
Figure 5:
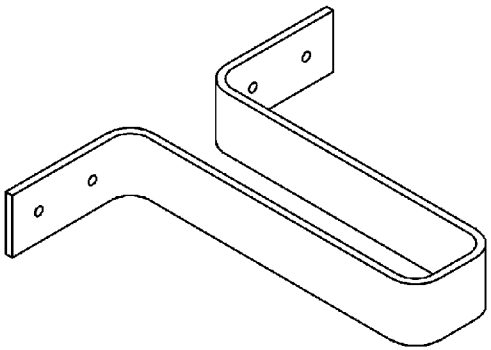
FIG. 5. Illustration of several views of one embodiment, with exemplary dimensions, of a double one side ladder bracket. A) Perspective (isometric) view. B) Front view. C) Side view.
Figure 5:
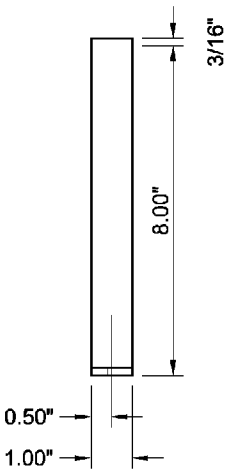
Figure 5:
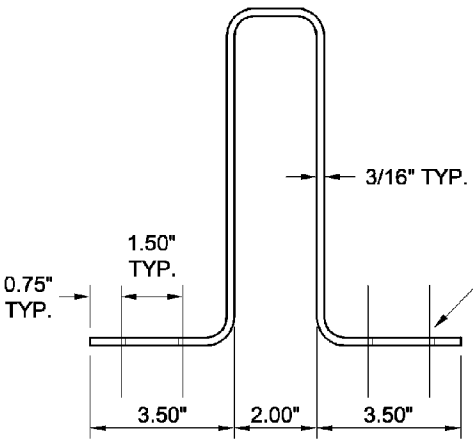
Figure 6:
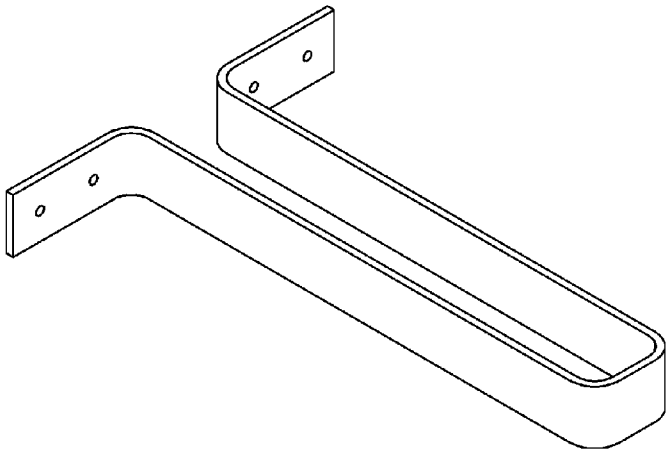
FIG. 6. Illustration of several views of one embodiment, with exemplary dimensions, of a double plus gutter, one side ladder bracket. A) Perspective (isometric) view. B) Front view. C) Side view.
Figure 6:
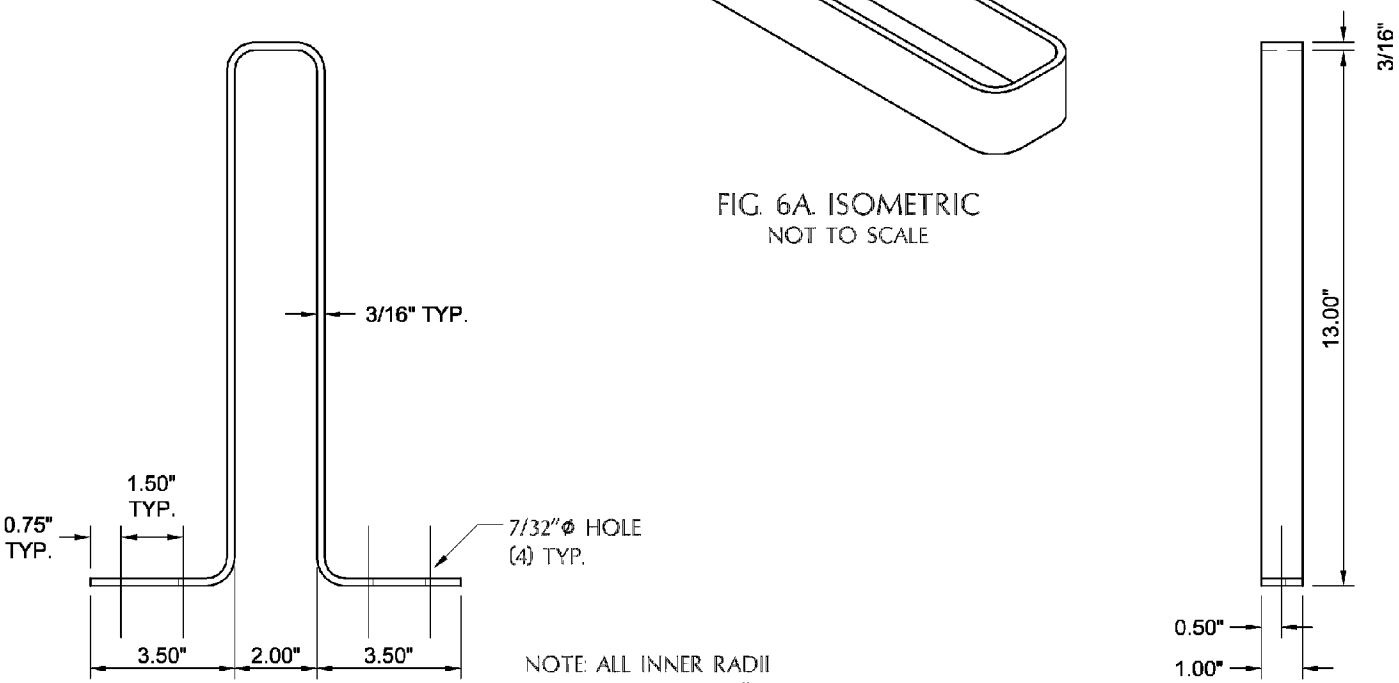

The mounting member is attached to a lateral stop 3. The lateral stop extends outward away from the structure and limits lateral (side to side) movement of the ladder. The lateral stop is sized to extend from the mounting member past the side rail or rails of a ladder that is leaning, at a proper angle, against the structure, when the bracket is positioned near the point of contact of the ladder with the structure. For a single ladder (FIGS. 1, 4) leaning against a roof edge with the bracket attached to a fascia board (FIG. 14), this length is about 5 inches, but may be more or less. For a double ladder (FIG. 5), this distance may be about 8 inches but may be more or less. This length may be further increased, about 1 inch, to accommodate a ladder that is leaning against a gutter apron or roof apron. The length may be more, about 13 inches, if the bracket is to be sized to fit over a ladder leaning against a gutter or other component of the structure (FIGS. 3, 6).

The lateral stop is attached to a transverse member 4. The transverse member extends over at least one side rail of a ladder and limits movement of the ladder outward away from the structure. The transverse member is sized to allow the member to extend over a single side rail of a ladder (FIG. 4-7, one side) or over both side rails of a ladder (FIGS. 1 and 3, full wrap). In other words, the length of the transverse member is greater than the width of a single side rail or greater than the distance from side rail to side rail when measured from the outside edges of the side rails. For extending over a single side rail (one side), this length is about 2 inches, but may be more or less. The length of a single side rail transverse member can be: 1", 1¼", 1½", 1¾", 2", 2¼", or 2½". For extending over both side rails of a ladder (full wrap), this distance may be about 19 inches but may be more or less. The length of the full wrap transverse member can be: 12", 13", 14", 15", 16", 17", 18", 19", 20", 21", 22", 23", or 24".

The transverse member 4 can provide two functions. First, the transverse member reduces the possibility of the upper end of the ladder separating the form structure. Thus, a force applied against the upper part of the ladder and away from the structure is less likely to cause the upper end of the ladder to fall away from the structure. Second, if the lateral stop is of an appropriate dimension, the transverse member secures the ladder sufficiently close to the structure such that base of the ladder is less likely to slide away from the structure. As the ladder leans against the structure, the ladder bracket is positioned below the point of contact of the ladder with the structure. As the base of the ladder is moved away from the structure the distance between the structure and the ladder, at the height of the bracket, is also increased. Contact of the ladder with the transverse member thus limits this distance and thereby movement of the base of the ladder away from the structure.

Figure 7:
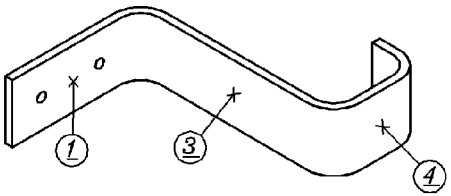
FIG. 7. Illustration of several views of one embodiment, with exemplary dimensions, of a ladder security bracket comprising a single attachment member 1, a single lateral stop member 3, and a U-shaped transverse member 4. The U-Shaped transverse member is sized to fit of the rail of a ladder.
Figure 7:
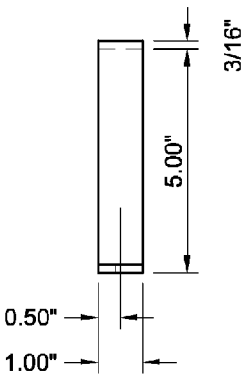
Figure 7:
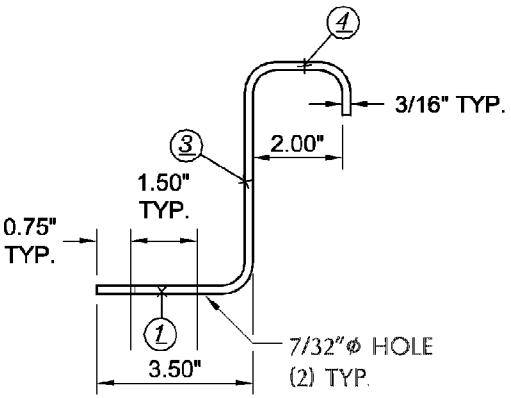

In one embodiment, the ladder bracket contains a single mounting member, a single lateral stop, and a transverse member sized to extend over a single ladder side rail (FIG. 7). In one embodiment, the transverse member preferably contains a hook at its distal end (away from the lateral stop). This hook extends at least partway back toward the mounting member, thus providing a lateral stop function. In another embodiment, the transverse member can be generally U-shaped. A U-shaped transverse member allows the member to more securely hold the ladder side rail. For single mounting member, single lateral stop brackets, it is preferable to use two such ladder brackets to secure the ladder. The two ladder brackets are then preferably positioned such the lateral stops are placed against an outside edge of each ladder side rail.

In another embodiment, the ladder bracket contains two mounting members and two lateral stops connected via a single transverse member. In this embodiment, the transverse member may be sized to extend over a one side rail of a ladder or over the entire width (full wrap) of the ladder. For brackets containing transverse members sized to extend over the entire width of the ladder, the bracket is positioned such that lateral stops are positioned to the outside of each ladder side rail.

When a ladder is placed against a structure at the recommended angle, or in accordance with ladder instructions, the ladder bracket can be mounted such that the mounting member is in contact with the structure and the transverse member is in contact or nearly in contact with the ladder side rail or rails. The length of the lateral stop is sufficient to provide for proper ladder angle. Preferably, a lateral stop is positioned to the outside of each ladder side rail. In this way, lateral movement of the ladder is limited in either direction. Because the transverse member is in contact or near contact with the ladder side rails, movement of the ladder away from the structure is limited. The ladder bracket is further positioned below the point of contact of the ladder with the structure. In this position, the bracket limits slippage of the ladder.

In one embodiment, a mounting member and a lateral stop member are made from a single piece of rigid or semi-rigid material. In another embodiment, a mounting member and lateral stop are not made from a single piece of material. In either embodiment, the angles 5,7 (FIGS. 1, 2) between the mounting member and the lateral stop member may be fixed or they may be independently adjustable. A wide variety of means are readily available in the art for attaching two rigid or semi-rigid members together, either at a fixed angle or at an adjustable angle.

In one embodiment, a lateral stop and transverse member are made from a single piece of rigid or semi-rigid material. In another embodiment, a lateral stop and transverse member are not made from a single piece of material. In either embodiment, the angles 6,8 (FIGS. 1, 2) between the lateral stop and the transverse member may be fixed or they may be adjustable. A wide variety of means are readily available in the art for attaching two rigid or semi-rigid members together, either at a fixed angle or at an adjustable angle.

Figure 8:
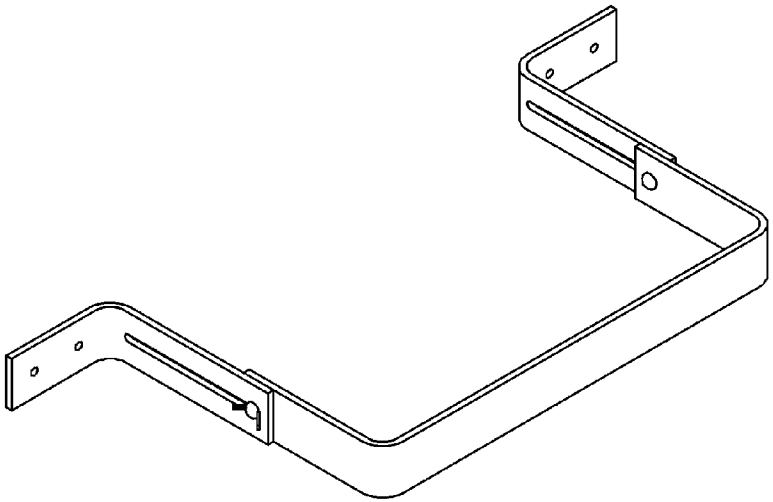
FIG. 8. Illustration of several views of one embodiment, with exemplary dimensions, of an adjustable full wrap ladder bracket containing adjustable length lateral stop members. A) Perspective (isometric) view. B) Front view. C) Side view.
Figure 8:
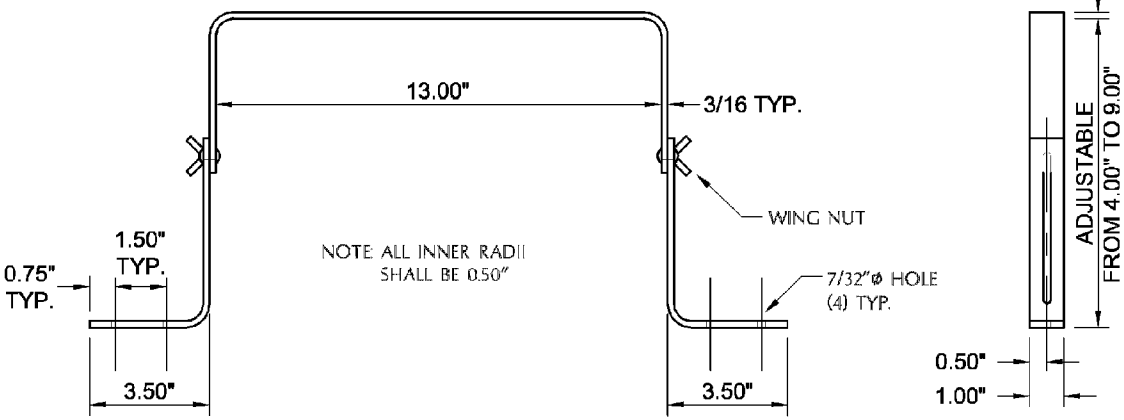
Figure 9:
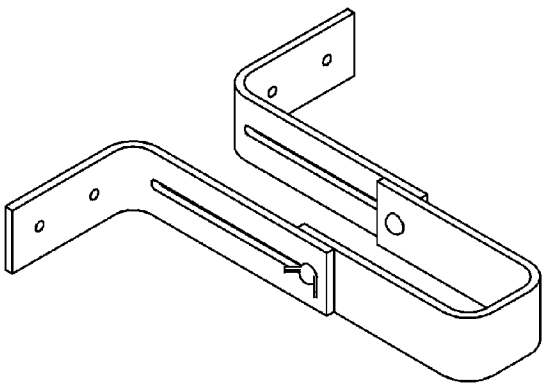
FIG. 9. Illustration of several views of one embodiment, with exemplary dimensions, of an adjustable one side ladder bracket containing adjustable length lateral stop members. A) Perspective (isometric) view. B) Front view. C) Side view.
Figure 9:
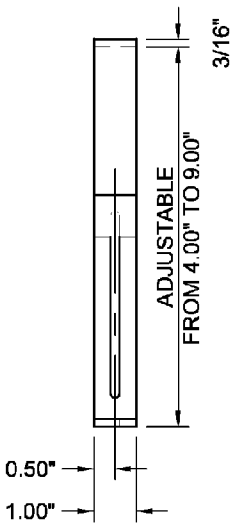

The lateral stop or the transverse member can be of fixed length (FIG. 1-5) or they can be of adjustable or variable length (FIG. 8-9, adjustable lateral stop length). If the length is to be variable, a number of means are known in the art to provide adjustable length. By way of example, the lateral stop or transverse member can be composed of two units, each of which has a slot running along at least a portion of the length of the unit. Alternatively, one component can have a series of one or more holes and the other component can have a slot. In yet another embodiment, both components can have a series of holes. A nut and bolt, pin or clamping mechanism, can then be used to affix the pieces to one another. Slots allow the units to be slid against one another thereby providing a variable overall length and accommodating the dimension of different ladders. Tightening of a nut, inserting a pin, or applying a clamp affixes the units at the desired length.

The angles between a mounting member and a lateral stop or between a lateral stop a transverse member may be fixed or they may be independently variable. Angles 5 and 6 (FIG. 1) are typically about 90°. However, other angles are permissible, with angles between about 80° and about 135° being preferred. Angles 5 or 6 can be 80°, 85°, 90°, 90°, 100°, 105°, 110°, 115°, 120°, 125°, 130°, or 135°. Angle 6 is typically chosen such that transverse member 4 is parallel to mounting member 1. Angles 7 or 8 (FIG. 2) can be 0° or they can be from about −45° to about +45° (FIG. 8C). Angles between about −20° and about +20° are preferred. Angles 7 or 8 can be −20°, −15°, −10°, −5°, 0°, +5°, +10°, +15°, or +20°.

The ladder security bracket can be made such that it is adjustable. The ladder security bracket can also be made in a wide range of non-adjustable sizes that correspond to the dimensions of different models or brands of ladders. Different brackets sizes can be made to be compatible with the ladders from different manufacturers. In a preferred embodiment, the ladder brackets are sized to work with class 1A heavy duty ladders or equivalent. Thus the present device is usable on substantially all ladders manufactured.

The present device is designed such that no modification of the ladder is required. Therefore the ladder strength as designed and built by the manufacturer is not altered by use of the ladder security bracket.

In a preferred embodiment, the ladder security bracket comprises two mounting members, two lateral stop members and one transverse member. The ladder security bracket can be made from a single piece of rigid or semi-rigid material. When made from a single piece of material, the bracket is easily and inexpensively manufactured. In one embodiment, the ladder security bracket is manufactured from a single 1" (inch) wide by 3/16" thick metal bar formed into the desired shape (see for example FIGS. 1, 3-6).

In another embodiment the transverse member is detachable from the lateral stop members. In another embodiment, the lateral stop members are detachable form the mounting members. In another embodiment, the transverse member and a first component of an adjustable lateral member are made from a single piece of rigid or semi-rigid material and the mounting member and a second component of an adjustable lateral member are made from a single piece of rigid or semi-rigid material (see for example FIGS. 8. 9).

The bracket can be made of a variety of durable and sufficiently strong materials in accordance with the principals of the invention, including, but not limited to: metal, steel, galvanized steel, aluminum, plastic, polymers etc. The material from which the bracket is made can be: flat stock, tubular, square, oval, I-beam, T-shaped, L-shaped, U-shaped, or V-shaped. However, the material is not limited to these shapes. In a preferred embodiment, the attachment member, lateral member and transverse member are made from rigid or semi-rigid material. In a preferred embodiment, the bracket is made from sufficiently heavy gauge (about 1/8" to about 1/4" thick) flat metal stock about 1/2" to about 2" wide. The bracket is molded or shaped, by any suitable process for forming the shape according to known means, depending on the material chosen may be utilized. The material can be ridged or dimpled for strength. The ladder bracket can have square, welded, or rounded corners. The corners can be reinforced or indented for added strength or rigidity. Preferably it is made of a material that is resistant to the environment or treated with a substance that renders the material resistant to the environment.

The security bracket is attached, temporarily, to the structure, with the transverse member over the side rails of the ladder towards the upper end of a ladder or extension ladder. The ladder is positioned such that it is leaning against the structure. The ladder security bracket is then positioned such that the transverse member rests against or is positioned near the edge of the ladder side rail that is away from the structure, the mounting member rests against the structure, and the lateral members project outwardly away from the structure, next to the side rails of the ladder, preferably on the outside of the ladder side rails. The ladder bracket is then secured to the structure such as by one or more nails or screws driven through holes in the mounting member into the structure. In one embodiment, the ladder is leaned against a roof eave and the bracket is attached to the fascia board. The attachment member can be affixed to the structure with one or more nails, screws, bolts, clamps or other means readily available in the art. Using the described bracket, the ladder is supported in a stable position and is prevented from excessive lateral movement, slippage, or falling.

Ladder Railing Bracket

In another embodiment, a ladder railing bracket or rail jack, is described. The ladder railing bracket is placed onto a ladder which is optionally secured to a structure, such as with the ladder security bracket described above, and provides a means to install one or more safety rails.

Ladder jacks are well known in the art and are typically used to hold a platform on a pair of laterally spaced ladders that are leaning against a structure. Ladder jacks contain ladder engagement members for attaching the ladder jack to an inclined ladder. One rung or single rung ladder jacks, two rung ladder jacks (short body ladder jacks) and three rung ladder jacks (long body ladder jacks) are known in the art. A one rung ladder jack comprises a single rung bracket adapted to fit over a rung a ladder (typically a heavy duty type 1A ladder) and a vertical post suspended perpendicularly from the rung bracket. The vertical post is typically sufficiently long to extend beyond at least one rung below the rung engaged by the rung bracket. When in place, the vertical post rests on the rung below the rung engaged by the rung bracket. A two rung ladder jack contains two rung brackets (rung bearing brackets), an upper and a lower rung bracket, each adapted to fit over a rung on a ladder and a vertical post connecting the two rung brackets wherein the rung brackets are connected to the vertical post at an appropriate spacing such that the two rung brackets engage and fit over adjacent rungs on the ladder. A three rung ladder jack contains an upper rung bracket and a lower bracket each adapted to fit over a rung of a ladder and a vertical post connecting the two rung brackets wherein the rung brackets are connected to the vertical post at an appropriate spacing such when the upper rung bracket engages and fits over a rung, the lower rung bracket engages and fits over a second rung that is two rungs below the rung engaged by the upper rung bracket. A three rung ladder jack may optionally contain a third rung bracket adapted to fit over a rung that is between the rungs engaged by the upper and the lower rung brackets.

Ladder jacks are known in the art for supporting work platforms between inclined ladders that lean against a structure, i.e., ladder jacks are scaffold supports which hook onto ladders. Thus, in addition to the ladder engagement members described above, a ladder jack typically further contains a horizontal support member to support a platform, plank, or stage. The horizontal support member is typically adjustable so that the horizontal support member is level or near level over a range of ladder angles. A platform, plank, or stage rests on the horizontal support member which in turn is connected to a ladder. Ladder jacks are typically used in pairs so that one ladder jack supports each end of a raised platform. A ladder jack scaffolding system thus comprises: two or more laterally spaced inclined ladders, wherein ladder jacks on each ladder support a work platform or stage suspended between adjacent inclined ladders, thereby creating an elevated work stage.

The raised platforms created by ladder jack systems known in the art fail to provide protection against workers falling off the raised platform. The ability to provide a safety rail would increase the safety while using such platforms. The present invention solves this problem by providing railing support systems which hook onto inclined ladders. The described invention, ladder railing bracket or rail jack, pertains to a safety rail support system designed to work in conjunction with ladder jack scaffolding systems. When combined with the ladder bracket described above or other means to secure the ladder, the rail jack forms a ladder safety rail system.

Figure 10:
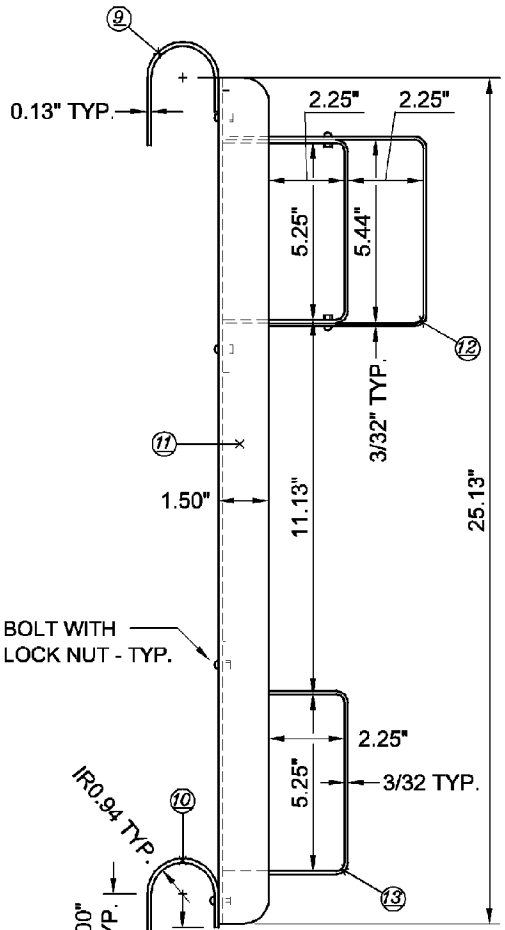
FIG. 10. Illustration of several views of one embodiment, with exemplary dimensions, of a three rung ladder railing bracket comprising upper rung engagement member 9, lower rung engagement member 10, vertical post 11, double upper rail bracket 12 and lower single rail bracket 13. A) Perspective (isometric) view. B) Front view. C) Side view.
Figure 10:
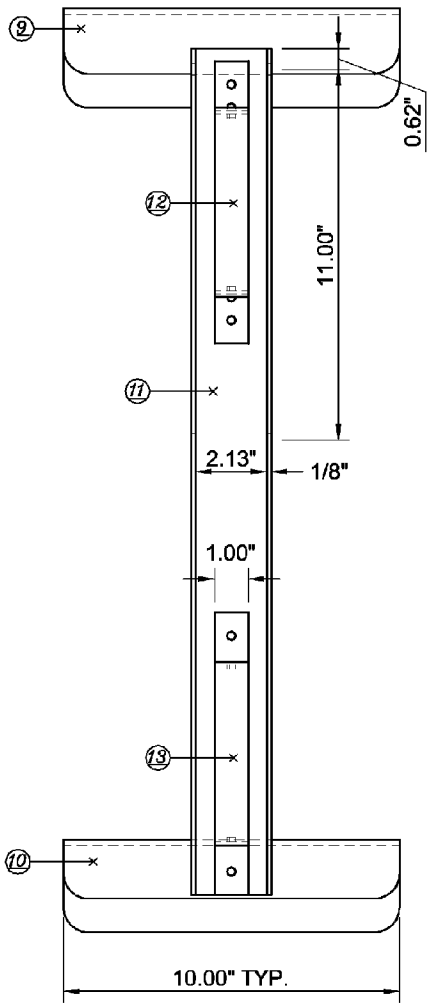
Figure 10:
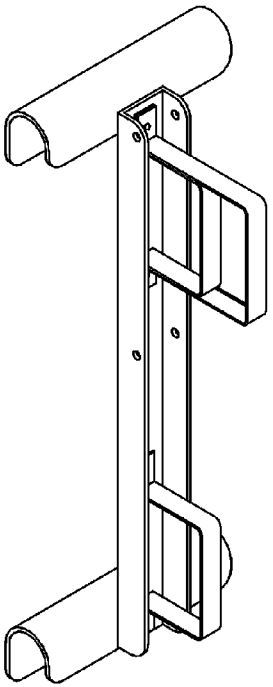
Figure 11:
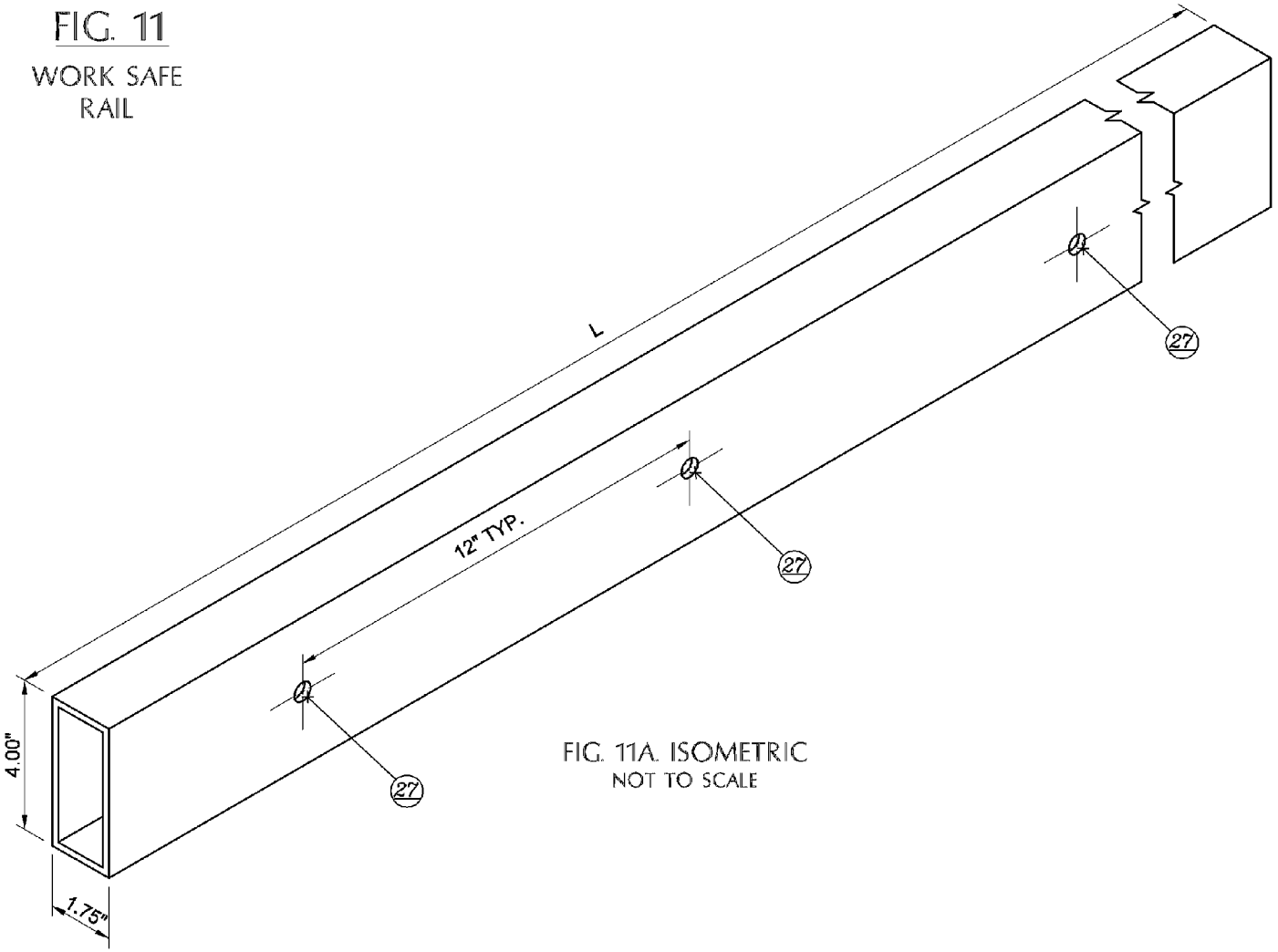
FIG. 11. Illustration of a perspective view, with exemplary dimensions, of a hollow aluminum rail with apertures 27.

The rail jack comprises: a ladder engagement member and at least one rail support member. The ladder engagement member comprises at least one rung bracket 9, 10 (FIG. 10) adapted to fit over a rung a ladder (typically a heavy duty type 1A ladder) and a vertical post 11. Preferably, the ladder engagement member contains at least two rung brackets. The ladder engagement member can be the same or similar to those known in the art for ladder jacks. A preferred ladder engagement member contains at least two rung brackets, an upper rung bracket 9 and a lower rung bracket 10, connected by one or more vertical posts 11. The upper and lower rung engagement members can be spaced to engage adjacent rungs (as for two rung ladder jacks). Alternatively the upper and lower rung brackets can be spaced to engage two rungs that are separated by another rung (as for three rung ladder jacks). The rail support member is designed to securely hold a rail which forms the railing.

In one embodiment, the ladder engagement member of the rail jack comprises a first inverted U-shaped component, termed a rung bracket or rung hook, adapted and sized to fit over the rung of a ladder, said rung bracket being connected by a rigid vertical post to a second inverted U-shaped component. Said second inverted U-shaped component is also adapted and sized to fit over the rung of a ladder, and is also a rung bracket or rung hook. Each rung hook is sized to fit over a rung and between the two side rails of the ladder. Therefore the length of each rung bracket is less than the inner distance between the ladder side rails. The rung bracket is at least long enough to conform to safety regulations or guidelines. The rung bracket can be about 4" to about 12" in length or any length in between. In a preferred embodiment, the rung bracket is about 10" in length. The two rung brackets may be the same length or they may be different lengths. For two-rung rail jacks, the distance between the two rung brackets is about the same as the distance between adjacent rungs (measured from one rung to the next) on a ladder and can be adjustable for placement on ladders with different rung to rung spacing. For three-rung rail jacks, the distance between the two rung brackets is about the same as the distance between three rungs on a ladder (measured from rung to rung), or about 24.13" and can be adjustable for placement on ladders with different rung to rung spacing.

Connected to a rung bracket or to the vertical post is the rail support member. The rail support member comprises at least one rail bracket 12, 13 and optionally a rail post wherein the rail bracket is adapted to fit, support, or secure a rail. The rail bracket can be designed and sized to fit any type of railing or bar which meets appropriate safety regulations. The rail support member can be designed to hold one or more safety rails. The rail support member is designed to hold the safety rail such that the rail runs roughly parallel to the ground, an elevated work platform (such as is held by ladder jacks) or the rungs of the ladder. The rail bracket can be attached directly to the ladder engagement member (a rung bracket or the vertical post) or to a rail post. If connected to a rail post, the rail post is connecting to the ladder engagement member. If a rail post is used, the at least one rail bracket and rail post together form the rail support member.

In one embodiment, the rail bracket comprises a circular, oval, square, rectangular, or polygonal hoop, ring, or slot through which a rail can be slid or inserted. In another embodiment, the rail bracket comprises a U-shaped or similarly shaped hook or cradle into a rail can be set. In yet another embodiment, the rail bracket can hold, support, or secure a rail by a fastener known in the art such as a bolt. In one embodiment, the rail bracket ring or hook is sized to be slightly larger than the intended rail, thus allowing the rail to be readily slid through the rail bracket.

In one embodiment, the rail bracket may comprise a flat metal strap or rod bent or adapted to form a rectangle, wherein the rectangle is sized to fit or wrap around a rail, such as, but not limited to, a 2×4 or 2×6 board or metal rail. In one embodiment, a preferred rail is a rectangular hollow aluminum beam of outside dimensions 1¾" (width) by 4" (height). It is understood by those knowledgeable in the art that the actual dimensions of 2×4 or 2×6 boards are about 1.5" by 3.5" and 1.5" by 5.5", respectively. The size of the slot is such that the rail can slide readily through the bracket. By way of example, for a 1¾" by 4" aluminum rail, the rail bracket can from a rectangular ring with an internal opening of about 2-2½" by 4¼-5½". The intent of the rail bracket is to secure a rail and is therefore not intended to be limited to this shape or this dimension. A large number of shapes and sizes are readily conceived which will hold a railing that can be used within the intended scope of the invention. The rail bracket must be able to hold or support the rail in a manner that is sufficiently secure. Sufficiently secure means that the rail will not be readily displaced from the bracket without a specific intentional act by a person.

The rail can be any material of sufficient size and strength to serve as a railing between two laterally spaced inclined ladders. By way of example, the rail can be any sufficiently strong plank or railing material, such as a metal beam, that meets appropriate safety guidelines or regulations for railings. The rail can be any elongated square, rectangular, oval, or round metal or composite stock (i.e. a square, rectangular, round, or oval pipe). A rail can also be a wooden board, such as what it referred to in the art as a 2×4 or 2×6. In one embodiment, the rail comprises a hollow aluminum 2×4 (actual dimensions are about 1¾" (inches) by about 4"). The 2×4 contains two 2" (1¾") faces and two 4" faces. The aluminum rail can be about 6 to about 20 feet long or longer.

The rail bracket or rail may contain a means by which to secure the rail to the bracket. In one embodiment, holes or apertures centered in the 4" face of a hollow aluminum 2×4 rail are placed about every 6-12" along the length or the rail. The holes can be through a single 4" face or pairs of holes can be aligned through both 4" faces such that a pin can be placed through the rail. Placement of a pin through a hole in the rail can prevent sliding of the rail through the rail support member, thus securing the rail to the rail jack. The pin should be of sufficient length such that when it is secured in the rail, it extends sufficiently outward from the rail to prevent sliding of the rail through the rail support member past the pin. In another embodiment, the rail support member can have an aperture or hole such that a single pin can be placed through the rail support and into or through a hole in the rail.

In a preferred embodiment, the pin contains a means by which to secure it to the rail. In one embodiment, the pin is threaded, as in a bolt, and the holes in at least one face of the rail are also threaded to accept the pin. In another embodiment, the pin is threaded and corresponding nuts are affixed over the holes in the rail such that a pin inserted into a hole can engage the nut. In another embodiment, the pin contains a head at one end which is too large to fit through the rail hole, and a hole sized to fit a cotter pin (cotter pin hole), or the like, is present in the other end. Insertion of the pin through a rail hole followed by insertion of a cotter pin through the cotter pin hole secures the pin to the rail. In another embodiment, the pin contains, within its length, an enlarged portion that is too large to fit through the rail hole. In one end, the pin is threaded to fit a nut or contains a hole sized to fit a cotter pin. The distance between the enlarged portion and the threads or cotter pin hole is sufficient to allow the pin to be inserted through the rail and allow a nut to engage the threads or a cotter pin to be inserted into the cotter pin hole, such that the enlarged portion is on side of the rail and the nut or cotter pin is on the other, thereby securing the pin to the rail. The opposite end is of sufficient length such that it extends sufficiently outward from the rail to prevent sliding of the rail through the rail support member past the pin.

The rail support member can hold a rail near the ladder. Alternatively, the rail bracket can be extended out away from the ladder by a spacer which connects the rail bracket to the ladder engagement member. The spacer can be about 1 inch to about 12 inches. A rail support member can be connected to the vertical post of the ladder engagement member by a variety of means known in the art. In one embodiment the rail bracket or rail post is welded to the vertical post. In another embodiment the rail bracket or rail post is connected to the vertical post via one or more rivets or removable bolts. In yet another embodiment the vertical post is pivotably connected to one end of a rail post, preferably a lower end, and the upper end of the rail post is connected to the vertical post via an adjustable or rigid spacer. The spacer can then be designed to allow the upper end to the rail post to be positioned at variable distances from the vertical post. In this way, the rail post can be angled from the vertical post such that the rail post is roughly perpendicular to the ground (plumb) or to a platform attached to the ladder by a ladder jack. Thus, for pivotably attached rail posts, the rail post can be positioned at varying angles from the vertical post.

In one embodiment, the vertical post can be attached to the rail support member in a manner which provides for vertical adjustment of the rail bracket. A number of means are readily available in the art to provide for vertical adjustment of one member relative to another, i.e., attachment of a rail bracket to various vertically spaced positions on the vertical post. In this embodiment, vertical adjustment means indicates that the rail bracket can be placed at various places along the vertical post or at various positions below or above a rung along a line that runs parallel with the inclined ladder rail. In other words, vertical adjustment is not strictly along an imaginary line that is perpendicular with the ground or the elevated platform. However, variable adjustment of the rail bracket up or down along the incline of the ladder (when the ladder is in place) will in effect raise or lower the rail bracket relative to its height above the ground or a raise work platform. In one embodiment, the vertical post can be provided with a series of spaced through holes. The holes can be sized and spaced to correspond to similar holes, pegs, or hooks present in a rail bracket or rail post. The rail bracket or post can then be attached to the vertical post by bolting or hooking the rail bracket or post into a desired hole or series of holes in the vertical post. Conversely, the vertical post can have a series of vertically spaced pegs or hooks which fit into corresponding holes in the rail bracket or post. In yet another embodiment, the rail post can comprise two members that can be vertically adjusted relative to one another. In this embodiment, the first member is attached to the vertical post and the second member is attached to one or more rail brackets.

The rail jack is made to support at least one and as many as four rails, although more rails are possible. In one embodiment, the rail support member is adapted to fit and support an upper and a lower rail. For holding upper and lower rails, upper 12 and lower 13 rail brackets can be attached directly to the ladder engagement member or they can be attached to a rail post which is attached to the ladder engagement member. In another embodiment, the rail bracket, either the upper rail bracket, the lower rail bracket, or both, is designed to accommodate two rails. For holding two upper or two lower rails, a double rail bracket 12 is used. In this way a single bracket can hold two rails, one extending from the bracket in each direction. A double rail bracket contains two rail brackets arranged horizontally and in a direction perpendicular from the ladder rungs or such that two rails inserted into the double rail bracket can overlap or extend, at the same height, in opposite directions from the bracket.

In one embodiment, the rail jack can have one or more handles to facilitate carrying, moving, or placement of the rail jack on a ladder.

The safety railing system of the present invention can by made to conform with current safety regulations, such as those for railings and standard ladder jacks, including, but not limited to: strength of railing, size a railing material, height of primary and secondary railings above the work platform, rung bracket bearing area, material strength, and length of each rung bearing bracket.

The rail jack system is designed with work with, and provide a railing for, commercially available ladder mounted scaffolding systems known in the art, such as, but not limited to: stretch planks or walk planks mounted on ladder jacks. The rail bracket is positioned on the vertical post to form a railing system that complies with government safety regulations. Government safety regulations stipulate that a rail must be a specified height above the platform surface; e.g., 42 inches or 36 inches. Therefore, the rail bracket is positioned on the vertical post such that some portion of the rail, when positioned in the rail bracket is at 42" inches or 36 inches above the work surface of a typical ladder jack platform. For example, for a 4 inch wide rail, the top edge of the rail, when measured from the top surface of a platform (said platform being connected to a ladder via a ladder jack or other device), is between 42 inches to 46 inches above the platform for 42 inches height requirements or between 36 inches and 40 inches for 36 inches height requirements. For typical ladder jack systems the rail jack holds the bottom of the rail about 7 inches above an appropriate rung.

For rail jacks that hold two rails at different heights, the second rail is also positioned on the vertical post to form a railing system that complies with government safety regulations. Government safety regulations stipulate that a second rail must be a specified height above the platform surface; e.g., 21 inches. Therefore, the lower rail bracket is positioned on the vertical post such that some portion of the rail, when positioned in the rail bracket is at 21 inches above the work surface of a typical ladder jack platform. For example, for a 4 inch wide rail, the top edge of the rail, when measured from the top surface of a platform (said platform being connected to a ladder via a ladder jack or other device), is between 21 inches to 25 inches above the platform.

In a preferred embodiment, the rail jack is intended to be used with a second rail jack positioned on a second laterally spaced ladder. In this way, each rail jack supports or secures one end of a rail. In one embodiment, the rail bracket can be placed below a roofline, and above a platform, as describe above, for increased safety when working on the side of a structure, such as for siding, windows, etc. In another embodiment, the rail bracket can be positioned on the ladder such that the rail is above the lower roof line for increased safety when working on a roof.

The rail support member (one or more rail brackets or one or more rail brackets plus a rail post) can be adapted or modified such that it can be attached to commercially available ladder jacks. In this embodiment, the horizontal support member of the commercially available ladder jack is replaced by the rail support member.

The components of the ladder rail bracket can be made of a variety of durable and sufficiently strong materials in accordance with the principals of the invention, including, but not limited to: metal, steel, galvanized steel, aluminum, plastic, polymers etc. While the rung hooks are shaped to fit over a rung, the vertical post, rail post, and rail bracket can independently be made from flat, tubular, square, oval, I-beam, T-shaped, L-shaped, U-shaped, V-shaped, or other suitable material.

Figure 13:
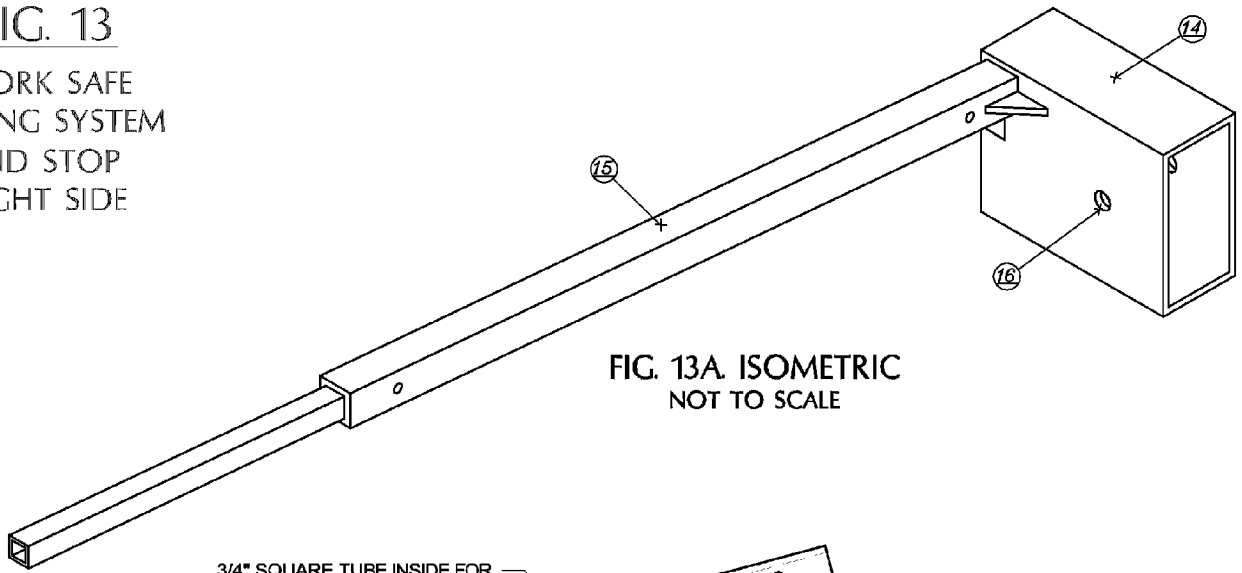
FIG. 13. Illustration of several views of one embodiment, with exemplary dimensions, of a right side railing system end stop comprising: rail sleeve 14, an adjustable length rail bar 15, and aperture 16. A) Perspective (isometric) view. B) Front view. C) Side view.
Figure 13:
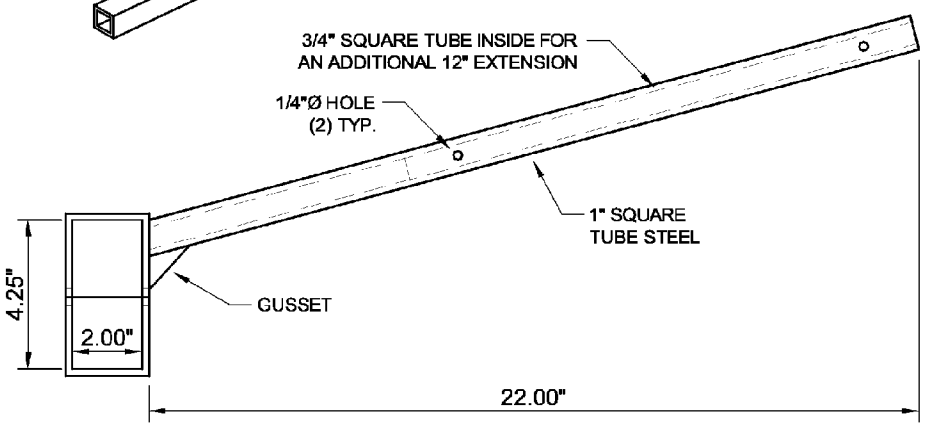
Figure 13:
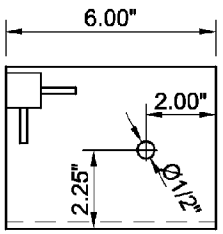

The ladder railing bracket may be used in conjunction with the previously described ladder security brackets (FIG. 13). By securing the ladder to the structure with the above described ladder security bracket, a more secure railing system is created. It is further possible for a worker to attach a safety harness to himself and to the railing created by the rail jack system. The harness can be made to slide along the length of the rail to allow the person to walk along the raised platform.

Railing System End Stops

Figure 12:
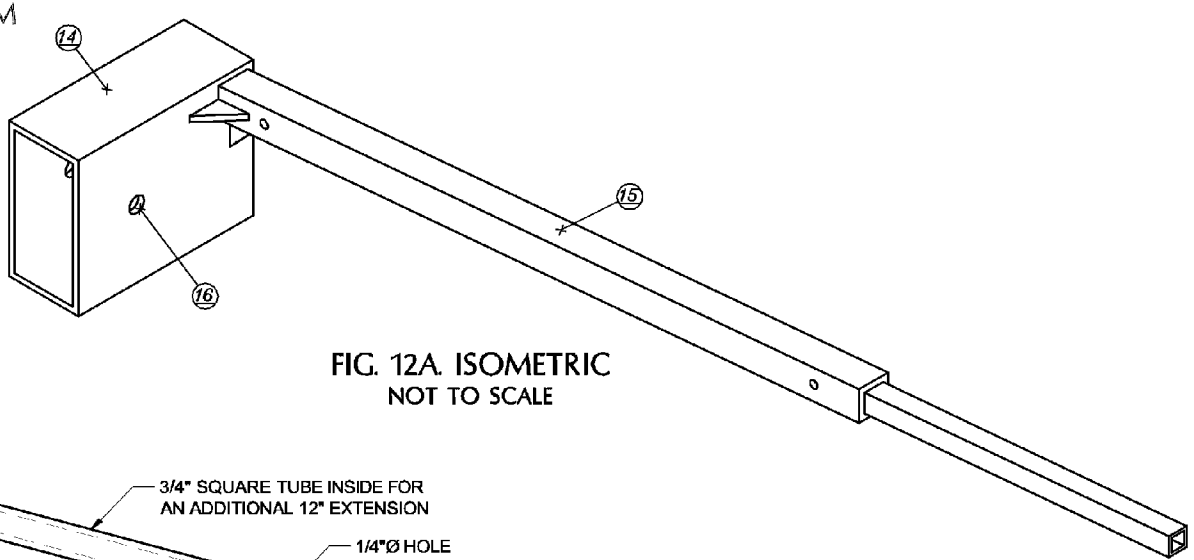
FIG. 12. Illustration of several views of one embodiment, with exemplary dimensions, of a left side railing system end stop comprising: rail sleeve 14, an adjustable length rail bar 15, and aperture 16. A) Perspective (isometric) view. B) Front view. C) Side view.
Figure 12:
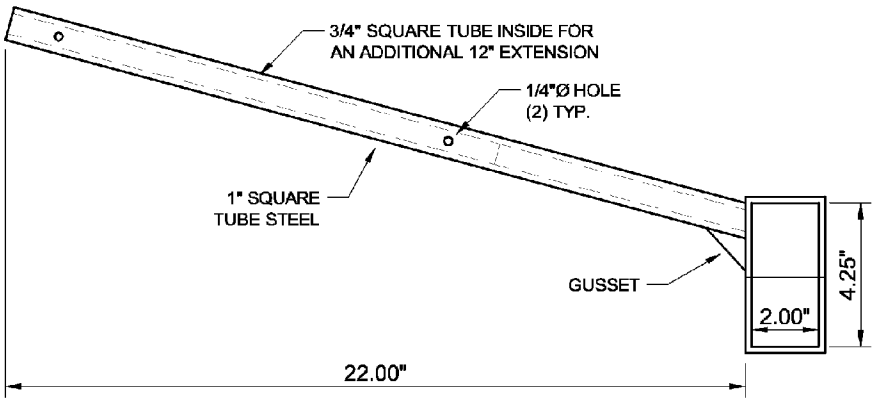
Figure 12:
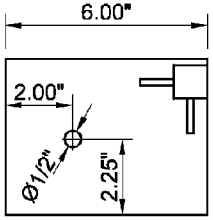

The railing system end stop comprises: a rail sleeve 14 sized to fit over an end of a rail and a perpendicularly attached rail bar 15 (FIG. 12-13). The rail sleeve comprises a fitting sized to fit around the rail. The end cap further comprises a means to attach the end stop to the rail. By way of example, a nut and bolt, pin, clamping means or other mechanism known in the art, can be used to affix the end stop to the rail. In one embodiment, the rail sleeve contains a hole or aperture 16 sized and positioned to correspond to a similar hole or aperture in the rail such that a single bolt or pin can be inserted through both the end stop an the rail. The rail bar is rigidly attached to the rail sleeve such that the rail bar extends perpendicularly to the length of the rail and extends outward from the rail at approximately the same height as the rail. Thus, the rail bar continues the rail in a direction perpendicular to the rail held by the ladder rail bracket. The end stops thereby create a railing at the ends of an elevated work platform, more fully enclosing the work area. Attachment of the rail bar to the rail sleeve can be reinforced with gussets for added strength. The rail bar can be about 20" to about 26" in length The end stop can be made from a single piece of rigid or semi-rigid material or from separate components. The end stop can be made of a variety of durable and sufficiently strong materials in accordance with the principals of the invention, including, but not limited to: metal, steel, galvanized steel, aluminum, plastic, polymers etc. The rail bar can be manufactured from round, tubular, square, oval, I-beam, T-shaped, L-shaped, U-shaped, V-shaped, or other suitable material.

Tool Hook

Figure 15:
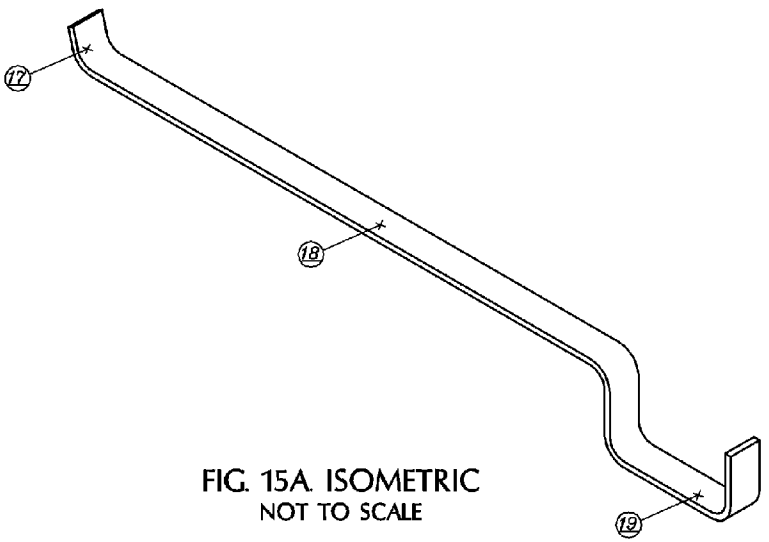
FIG. 15. Illustration of several views of one embodiment, with exemplary dimensions, of the described ladder rung hook comprising: an upwardly directed end 17, a rung spanning section 18, and tool hook 19.
Figure 15:
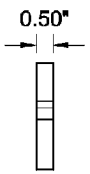
Figure 15:
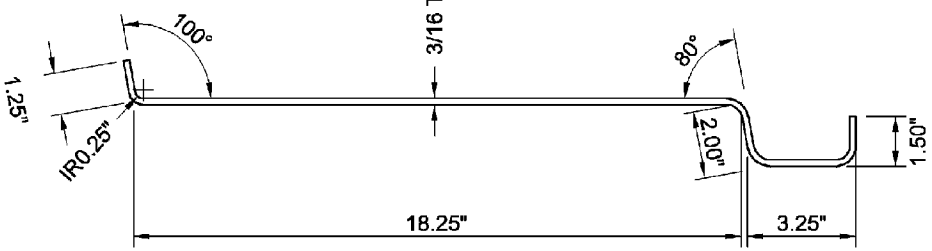
Figure 16:
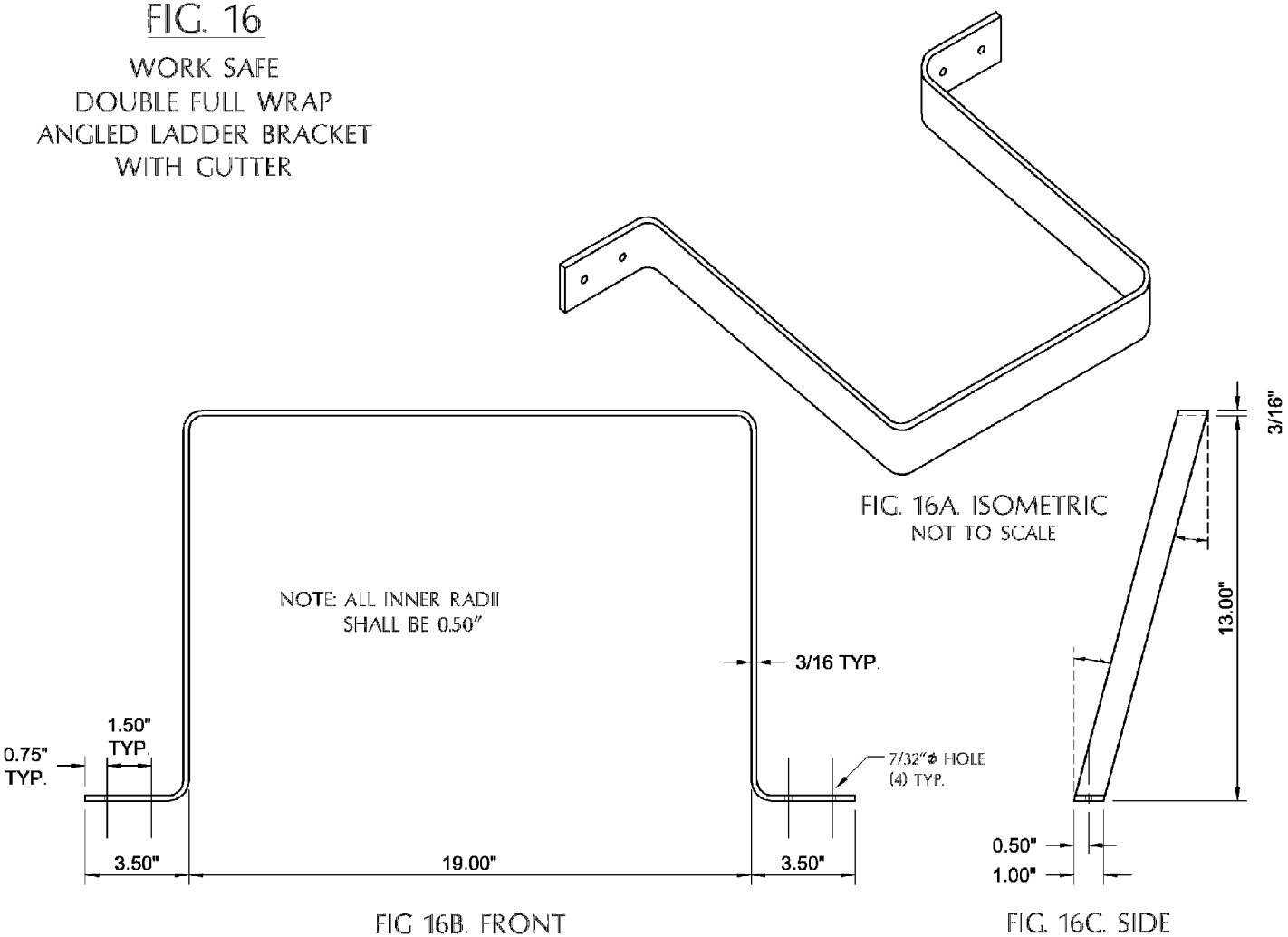
FIG. 16. Illustration of several views of one embodiment, with exemplary dimensions, of a double plus gutter full wrap ladder bracket with angled lateral stop members. A) Perspective (isometric) view. B) Front view. C) Side view of a bracket with an angle lateral stop member. An angled lateral stop member may be useful in combination with angled fascia boards.
Figure 17:
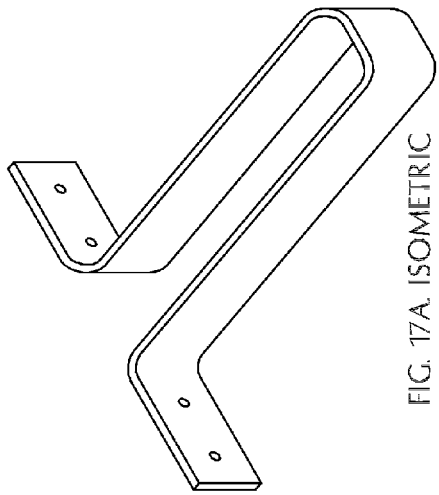
FIG. 17. Illustration of several views of one embodiment, with exemplary dimensions, of a double one side ladder bracket with angled lateral stop members. A) Perspective (isometric) view. B) Front view. C) Side view of a bracket with an angle lateral stop member. An angled lateral stop member may be useful in combination with angled fascia boards.
Figure 17:
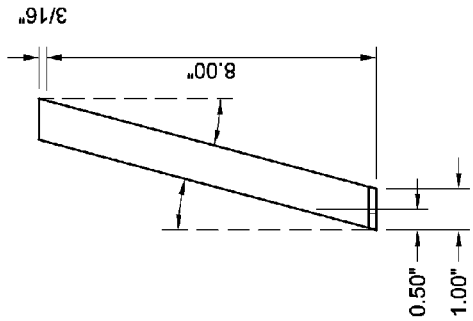
Figure 17:
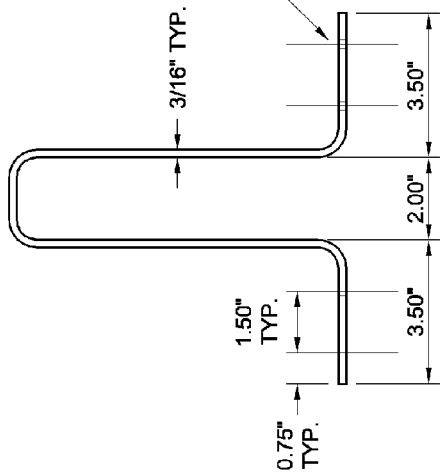
Figure 18:
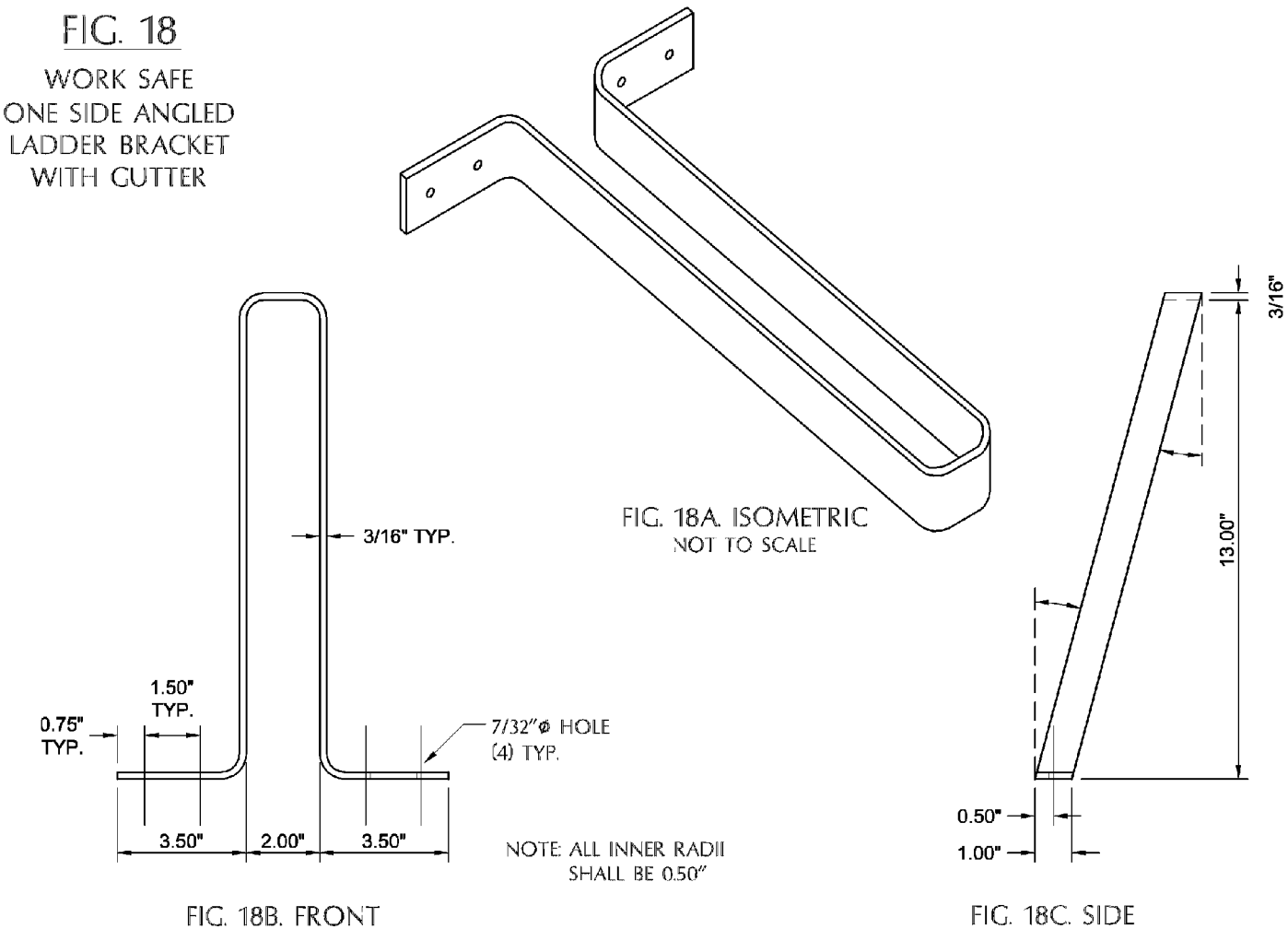
FIG. 18. Illustration of several views of one embodiment, with exemplary dimensions, of a double plus gutter one side ladder bracket with angled lateral stop members. A) Perspective (isometric) view. B) Front view. C) Side view of a bracket with an angle lateral stop member. An angled lateral stop member may be useful in combination with angled fascia boards.
Figure 22:
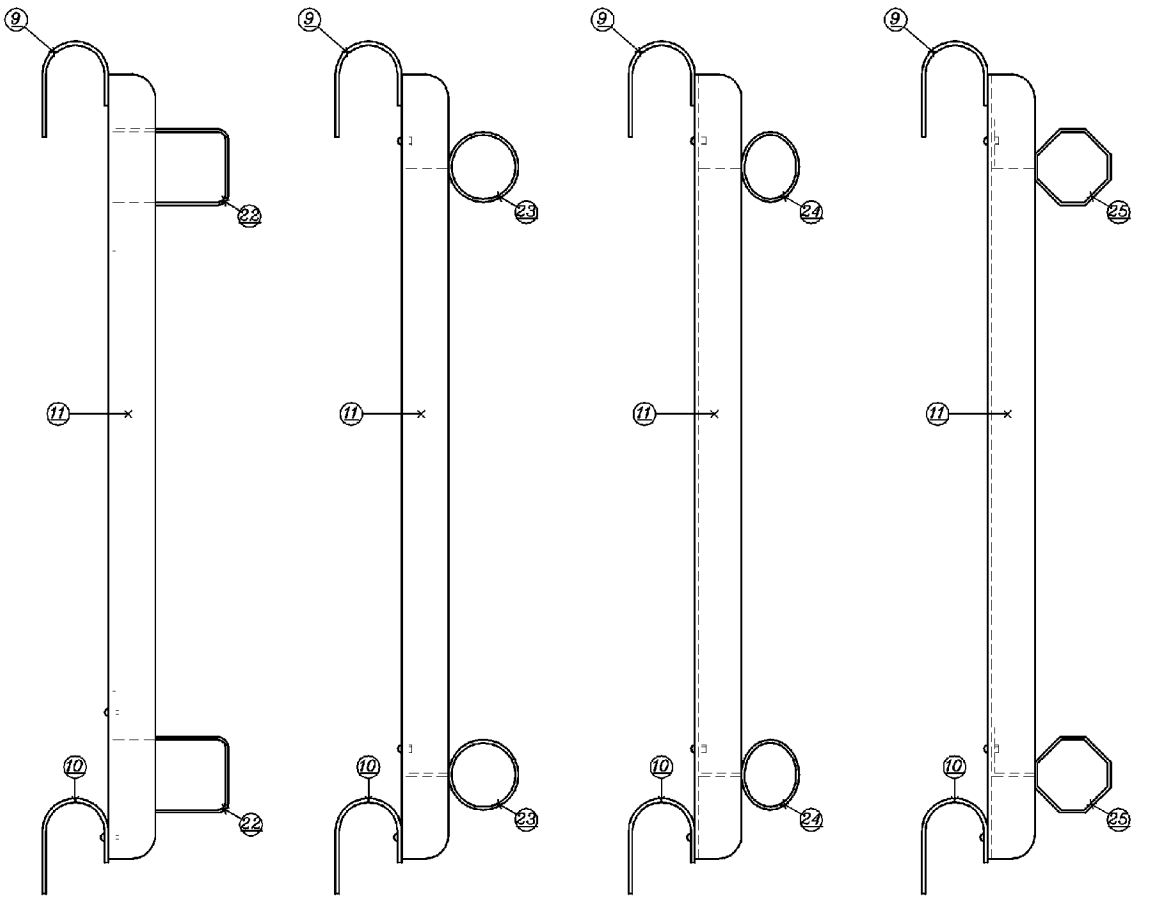
FIG. 22. Illustration of side views of several embodiment of a three rung ladder railing bracket comprising upper rung engagement members 9, lower rung engagement members 10, vertical posts 11, and (A) upper and lower square rail brackets 22, (B) upper and lower round rail brackets 23, (C) upper and lower oval rail brackets 24, and (D) upper and lower polygonal (hexagonal) rail brackets 25.

Also described is a tool hook for use with a ladder. The tool hook (FIG. 15) comprises, a rung spanning section 18, with an upwardly directed end 17 at one end and a tool hook end 19 at the other end. The upwardly directed end and rung spanning section are sized such that the upwardly directed end and can be readily passed through a hollow rung of a ladder. The upwardly directed end is preferably long enough such that the tool hook is not easily dislodged from the ladder without an intentional act by a person. The length of the rung spanning section is approximately equal to or longer than the rung of a typical construction ladder. Thus, when in place, with the rung spanning section running through the rung, the upwardly facing end extends outside of one end of the rung and the hook end extends outside the opposite end of the run. In one embodiment, the upwardly facing end is about 1¼" in length at an angle of about 100° (or about 90° to about 120°) from the rung spanning section. The hook end is attached to the opposite end of the rung spanning section from the upwardly facing end. The hook end is preferably sized such that it will not fit through the rung of the ladder. In one embodiment, the hook end comprises a U-shaped hook. However, the hook end can be of any desired size and shape to hold any particular hand tool typically used at a construction site. A U-shaped hook can have a curved bottom or a flattened bottom (as shown in FIG. 15). Preferably, at least one portion of the hook end nearest the rung spanning section extends downward, in the opposite direction of the upwardly facing end. In one embodiment, the side of a U-shaped hook nearest the rung spanning section extends downward about 2" at about 80° (or about 70° to about 90°) from the rung spanning section. The curved bottom of a U-shaped hook can have a radius of about ½" to about 2" or more. The flat bottom of a U-shaped hook can be about 1" to about 4" in length. The upwardly directed end assists in retaining the hook in place unless purposely removed from the rung of the ladder. Extra mass of the hook end can cause the hook end to be pulled towards the bottom of the rung opening when the tool hook in positioned in the ladder rung, resulting in the upwardly facing end to be forced upward, toward the top of the rung opening. In this position, the upwardly facing end extends above the top of the run, thus catching the rung and preventing the hook from readily being pulled through the rung accidentally or by the weight of the tool.

The tool hook can be made from a single piece of rigid or semi-rigid material or from separate components. The tool hook can be made of a variety of durable and sufficiently strong materials in accordance with the principals of the invention, including, but not limited to: metal, steel, galvanized steel, aluminum, plastic, polymers etc. The tool hook can further be manufactured from flat, round, tubular, square, oval, I-beam, T-shaped, L-shaped, U-shaped, V-shaped, or other suitable material. In one embodiment, the tool hook is manufactured from a single piece of flat metal, about ½" wide formed into the appropriate shape.

Example

Example 1

Ladder Safety System

Figure 14:
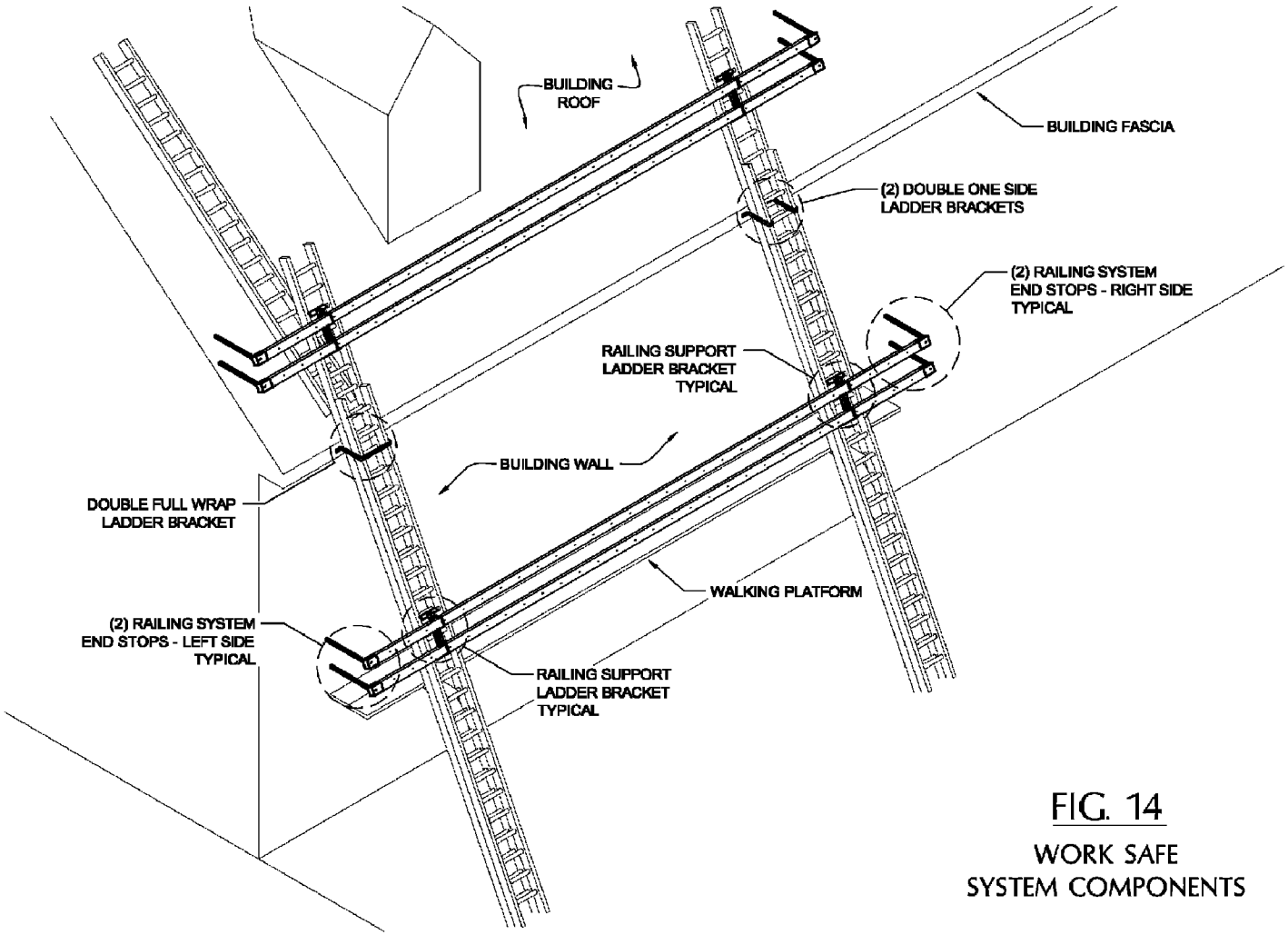
FIG. 14. Illustration of the ladder brackets, railing brackets, rails, and end stops of the present invention installed on two laterally spaced ladders thereby forming a ladder safety system.

FIG. 14 illustrated the components of the ladder safety system in use. Two laterally spaced ladders are in inclined positions leaning against a structure and are holding an elevated work platform. Ladder security brackets for each ladder are affixed to the structure and limit vertical and horizontal movement of the ladders. One of the ladder security brackets is further being used to secure a ladder against a structure wherein a force is being applied against the ladder away from the structure by a second ladder lying on the roof. One pair of ladder railing brackets are shown holding rails at appropriate heights above an elevate work platform. A second pair of ladder railing brackets are shown holding rails above the lower roof line. Railing end stops are used on each of the rails to more fully enclose the work area.

I claim:

1. A ladder mounted railing system consisting of:

a) an upper rung bracket and a lower rung bracket each adapted to fit over a rung of a ladder;

b) a vertical post rigidly connected to both the upper rung bracket and the lower rung bracket such that the rung brackets are positioned and spaced to simultaneously fit over rungs of a ladder; and c) a first U-shaped rail bracket wherein each end of said first U-shaped rail bracket is directly connected to said vertical post thereby forming a slot through which a rail can be inserted.

2. The railing system of claim 1 wherein the upper rung bracket and the lower rung bracket comprise an inverted U-shaped component sized to hook over a rung of the ladder.

3. The railing system of claim 2 wherein the inverted U-shaped component is about four inches to about twelve inches in length.

4. The railing system of claim 3 wherein the inverted U-shaped component is about ten inches in length.

5. The railing system of claim 2 wherein the upper rung bracket and lower rung bracket are spaced to engage adjacent rungs on the ladder.

6. The railing system of claim 2 wherein the upper rung bracket and lower rung bracket are spaced such that the lower rung bracket engages and fits over a second rung that is two rungs below the rung engaged by the upper rung bracket.

7. The railing system of claim 1 wherein the slot is designed and sized to fit a railing or bar which meets appropriate safety regulations.

8. A ladder mounted railing system comprising:

a) an upper rung bracket and a lower rung bracket each adapted to fit over a rung of a ladder;

b) a vertical post rigidly connected to both the upper rung bracket and the lower rung bracket such that the rung brackets are positioned and spaced to simultaneously fit over rungs of a ladder;

c) a first U-shaped rail bracket wherein each end of said first U-shaped rail bracket is directly connected to said vertical post thereby forming a slot through which a rail can be inserted wherein said slot is designed and sized to fit a rail which meets appropriate safety regulations; and, d) a second U-shaped rail bracket fitted over and directly connected to said first U-shaped rail bracket to form a second slot through which a second rail can be inserted.

9. A ladder mounted railing system comprising:

a) an upper rung bracket and a lower rung bracket each adapted to fit over a rung of a ladder;

b) a vertical post rigidly connected to both the upper rung bracket and the lower rung bracket such that the rung brackets are positioned and spaced to simultaneously fit over rungs of a ladder;

c) a first U-shaped rail bracket wherein each end of said first U-shaped rail bracket is directly connected to said vertical post thereby forming a slot through which a rail can be inserted wherein said slot is designed and sized to fit a rail which meets appropriate safety regulations; and, d) a lower U-shaped rail bracket wherein each end of said lower U-shaped rail bracket is directly connected to said vertical post to form a slot through which a lower rail can be inserted wherein said lower U-shaped rail bracket is connected to said vertical post below said first U-shaped rail bracket.

10. The railing system of claim 9 wherein a second U-shaped rail bracket is fitted over and directly connected to said first U-shaped rail bracket to form a slot through which a second upper rail can be inserted.

11. The railing system of claim 1 wherein said first U-shaped rail bracket is adjustably connected to said vertical post.

12. The railing system of claim 1 wherein said first U-shaped rail bracket is positioned to hold the bottom of a rail about 7 inches above a rung of the ladder.

13. The railing system of claim 1 wherein said first U-shaped rail bracket is positioned to hold a rail about 42 inches or about 36 inches above a platform that is also connected to the ladder.

14. The railing system of claim 9 wherein said first U-shaped rail bracket is positioned to hold a rail about 42 inches above a platform that is also connected to the ladder and said lower U-shaped rail bracket is positioned to hold a rail about 21 inches above a platform that is also connected to the ladder.

15. A ladder mounted railing system consisting of:

a) an upper rung bracket and a lower rung bracket each adapted to fit over a rung of a ladder;

b) a vertical post rigidly connected to both the upper rung bracket and the lower rung bracket such that the rung brackets are positioned and spaced to simultaneously fit over rungs of a ladder; and c) a hoop through which a safety rail can be inserted directly connected to said vertical post.

16. A method of mounting a rail on a pair of ladders comprising:

placing a first ladder mounted railing system of claim 8 on a ladder, placing a second ladder mounted railing system of claim 8 on a second laterally spaced ladder and inserting a rail into the slots of the ladder mounted railing systems such that the rail is supported by the ladder mounted railing systems.

17. A ladder mounted railing system consisting of:

a) an upper rung bracket and a lower rung bracket each adapted to fit over a rung of a ladder;

b) a vertical post rigidly connected to both the upper rung bracket and the lower rung bracket such that the rung brackets are positioned and spaced to simultaneously fit over rungs of a ladder; and c) a hook into which a safety rail can be set directly connected to said vertical post.

* * * * *